US010118803B2

(12) United States Patent
Hengst et al.

(10) Patent No.: US 10,118,803 B2
(45) Date of Patent: Nov. 6, 2018

(54) SERVICE APPARATUS FOR AN ESCALATOR OR MOTORIZED STAIRWAY

(71) Applicant: Thomas Walker Hengst, Dallas, TX (US)

(72) Inventors: Thomas Walker Hengst, Dallas, TX (US); Bruce McLellan, Round Rock, TX (US)

(73) Assignee: Thomas Walker Hengst, Dallas, TX (US)

( * ) Notice: Subject to any disclaimer, the term of this patent is extended or adjusted under 35 U.S.C. 154(b) by 169 days.

(21) Appl. No.: 15/047,852

(22) Filed: Feb. 19, 2016

(65) Prior Publication Data

US 2016/0244300 A1 Aug. 25, 2016

Related U.S. Application Data

(60) Provisional application No. 62/118,311, filed on Feb. 19, 2015.

(51) Int. Cl.
*A47L 9/02* (2006.01)
*B66B 31/00* (2006.01)

(52) U.S. Cl.
CPC ..... *B66B 31/003* (2013.01)

(58) Field of Classification Search
CPC ... B66B 31/003; B66B 31/00; A47L 11/4052; A47L 11/4061
See application file for complete search history.

(56) References Cited

U.S. PATENT DOCUMENTS

| | | | |
|---|---|---|---|
| 3,559,230 | A | 2/1971 | Ogle |
| 3,678,553 | A | 7/1972 | Cravits |
| 3,869,749 | A | 3/1975 | London et al. |

FOREIGN PATENT DOCUMENTS

| | | |
|---|---|---|
| DE | 4436551 | 12/1995 |
| WO | WO2006122739 | 11/2006 |

OTHER PUBLICATIONS

Cleanmaster Corporation, Owner's Manual—TreadMaster Escalator Step Cleaner, Jun. 12, 1997, revised Mar. 6, 1998, pp. 1-16, Cleanmaster Corporation, Mukilteo, Washington, USA.

*Primary Examiner* — Shay Karls
(74) *Attorney, Agent, or Firm* — Clark Hill Strasburger

(57) ABSTRACT

A system and method for simultaneously cleaning riser and step portions of movable stairs in an escalator is disclosed. The system includes a frame comprising a set of guide arms, a set of first service systems movably connected to the frame, and a set of second service systems removably mounted to the frame. The first service system includes a set of interchangeable servicing units. The set of second service systems is optionally interchangeable. The method including the steps of engaging the set of second service systems with each movable stair of the set of movable stairs and simultaneously engaging the set of first service systems with a riser portion of each movable stair of the set of movable stairs and a step portion of each movable stair of the set of movable stairs.

12 Claims, 16 Drawing Sheets

SERVICE APPARATUS FOR AN ESCALATOR OR MOTORIZED STAIRWAY

CROSS-REFERENCE TO RELATED APPLICATION

This application claims priority to U.S. Provisional Application No. 62/118,311, filed Feb. 19, 2015. This patent application is incorporated herein by reference in its entirety to provide continuity of disclosure.

FIELD OF THE INVENTION

The present disclosure relates generally to devices and systems in facilities management industry and more specifically, devices and systems directed towards service of escalators and motorized stairways including cleaning and maintenance.

BACKGROUND OF THE INVENTION

Operations management of buildings and facilities require regular maintenance of a variety of fixtures, features, appliances or the like. Many building have motorized stairways and/or escalators to carry passengers between locations. In modern escalators are comprised of a series of movable stairs, each movable stair having step portions and riser portions. The step portion may be generally horizontal and level when in position parallel to the ground on corresponding axles of the escalator. This causes the step portion to form a horizontal stepping surface upon which passengers may walk or remain stationary while using the escalator. Commonly, the step portion may include non-skid features which can be formed from ridges and/or grooves. In turn, the riser portion may at least be partially generally perpendicular to the step portion.

During management of commercial buildings having escalators, maintenance can include regular servicing to ensure a given escalator is clean and in working condition. However, escalators have been known to become unclean with dirt, dust, and other particulate quickly becoming visible, lodged, or otherwise accumulated into these rides and/or grooves as a result of use by passengers. Current approaches to this problem include having maintenance employees spend substantial amounts of time which can be up to 40 hours weekly to simply service escalators or motorized stairways. Even with this substantial labor cost, certain situations require more than 40 hours weekly devoted towards system maintenance.

Therefore, there exists a need to provide a solution that is capable of maintaining devices such as escalators or motorized stairways that is easy to use, reduces the costs in servicing and/or maintaining devices such as escalators or motorized stairways, as well as reducing the risk of injury to those passengers using and/or operators servicing these devices. There also exists a need to provide a solution to the herein discussed problems that can be produced inexpensively.

SUMMARY

In some embodiments, an apparatus for servicing an escalator or motorized stairway is provided to clean, maintain, or otherwise ensure the escalator or motorized stairway having a plurality of movable stairs is kept in working order. In this regard, the apparatus may include a support frame having a base and an upright arm guide. The support frame may be constructed from any useful shape to satisfy the herein disclosed solutions but preferably is manufactured from rectangular metallic structure that can be molded, welded, or otherwise fastened together. The support frame is not so limited and may be constructed from any number of shapes and any number of materials including composites, plastics or other materials.

A first service system of the apparatus may be slidably inserted into the upright arm guide, wherein the first service system is designed to clean, maintain, or otherwise service riser and step portions of the movable stairs while the movable stairs are in motion. In this respect, the first service system may be movable relative to the support frame between a plurality of planes, positions, and/or orientations. In certain embodiments, the first system is freely movable between planes, positions, and/or orientations based on motion of the movable stairs of the escalator or motorized stairway. A second service system of the apparatus may also be mounted to the base of the frame, wherein the second service system is designed to clean, maintain, or otherwise service a step portion of each movable stair while the plurality of movable stairs are in motion.

The second service system may be mounted to any portion of the base of the support frame but preferably is mounted to the forward portion of the support frame so that it may be situated adjacent to or in communication with the step portion of one of the movable stairs when the apparatus is positioned at an entrance of the escalator or motorized stairway.

In some embodiments, the first and second service systems may be of various sizes to fit various widths of movable stairs. In these embodiments, the first and second service systems are removable and interchangeable.

In some embodiments, the first and second service systems may be operable to clean an entire width of the riser and step portions of one of the movable stairs while the plurality of movable stairs are in motion.

The first service system may include a frame arm that is slidably inserted into the upright arm guide and may be translatable between one or more predetermined positions. A pivot arm may be pivotally attached to the frame and preferably, a proximal portion of the pivot arm may be freely pivotally attached to the frame arm. A slide arm may be slidably attached to the pivot arm beginning at the distal portion and may be freely slidable between one or more predetermined positions on the pivot arm. A lever with proximal and distal portions may have its proximal portion mounted to the slide arm. A first servicing unit may be operatively connected to the distal portion of the lever through any reasonably fastening manner including removable fasteners, welding, or the like. The first servicing unit may be designed to clean the riser and step portions of each movable stair while the plurality of movable stairs are in motion and remove particulate therefrom.

In some embodiments, the first service system includes a set of arms pivotally connected to the frame.

In some embodiments, the first service system is stored on top of the support frame. In these embodiments, the pivot arm pivots to a support position adjacent to the support frame.

The upright arm guide of the support frame may include a plurality of receivers and the frame arm of the first service system may include a plurality of guide members so that each of the guide members may be slidably received collectively or individually by a respective receiver of the upright arm guide between one or more positions.

In some embodiments, a lever angle may be formed between the proximal and distal portions of the lever and the lever angle may be adjustable between a plurality of different angles as needed or required.

The slide arm of the first service system may also include a rotatable guide member positioned on a distal end of the slide arm so that when the rotatable guide member is moved along the plurality of movable stairs, the rotatable guide member guides the first servicing unit during and between cleaning of the riser and step portions of the plurality of movable stairs.

The first servicing unit of the first service system may include a sprayer system in communication with the distal portion of the lever and a motor in communication with a brush system to remove particulate from the riser or step portions of each movable stair. The sprayer system may be designed to distribute liquid solution onto each movable stair. In this respect, the sprayer system may include a spray nozzle operable to distribute a predetermined amount of liquid solution on the riser portion of each movable stair and distribute a predetermined amount of liquid solution on the step portion of each movable stair. The brush system of the first servicing unit may include a rounded elongate brushed member operable to be rotated and continuously or intermittently driven by the motor along the riser or step portion of each movable stair while the movable stairs in motion.

The second service system of the apparatus may also comprise a motor in communication with a brush system to remove particulate from the riser or step portion of each movable stair. The brush system of the second service system in turn may include a rounded elongate brushed member operable to be rotated and continuously or intermittently driven by the motor along the step portion of each movable stair while the movable stairs are in motion. The second service system may also include a vacuum system in fluid communication with the brush system through a hose, the vacuum system comprising a vacuum container and a vacuum motor, the vacuum motor operable to cause fluids and particulate collected in a brush cover of the brush system to be drawn from the brush system through the hose into the vacuum container.

In certain embodiments, a plurality of support wheels may be mounted underneath the support frame. Preferably, the support wheels are swivel wheels. The apparatus may also include a locking mechanism designed to releasably secure the apparatus to guide rails of the escalator or motorized stairway once the apparatus is received by the escalator or motorized stairway itself (e.g. by being positioned adjacent to or upon the entrance of the escalator or motorized stairway). The locking mechanism may be constructed from one or more elongate members extending outwardly from the support frame so that each elongate member is capable of releasably securing the apparatus upon contact with the guide rails. Accordingly, now secured, the support frame in combination with the locking mechanism is capable of laterally automatically moving along a width of each movable stair of any size.

A method is also disclosed for simultaneously cleaning riser and step portions of movable stairs in an escalator, the method comprising: attaching first and second service systems to a support frame, the first service system being slidably attached to an upright arm guide of the support frame and movable relative to the support frame between a plurality of planes, the second service system being attached to a base of the frame; positioning the support frame and the second service system adjacent to or in communication with the step portion of one of the movable stairs of the escalator; servicing the step portion of each movable stair by contacting or communicating the second service system with the step portion of each movable stair; and servicing the step and riser portions of each movable stair by causing the first service system to freely move between planes as each movable stair is moved by the escalator.

In certain embodiments, the method may include: supporting the support frame with a plurality of swivel wheels; and releasably securing the support frame to guide rails of the escalator by extending one or more elongate members outwardly from the support frame until contacting the guide rails. In other embodiments, the method may also comprise laterally automatically moving the support frame and each of the first and second service systems along a complete width of the movable stairs of the escalator.

The herein disclosed method may also include removing fluids or particulate from the step portion or riser portion of each movable stair while in motion by drawing fluids or particulate through a vacuum system having a hose in fluid communication with the second brush system, the vacuum system including a vacuum container and a vacuum motor operable to draw fluids or particulate collected in a brush cover of the second brush system to be drawn from the second brush system through the hose into the vacuum container.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
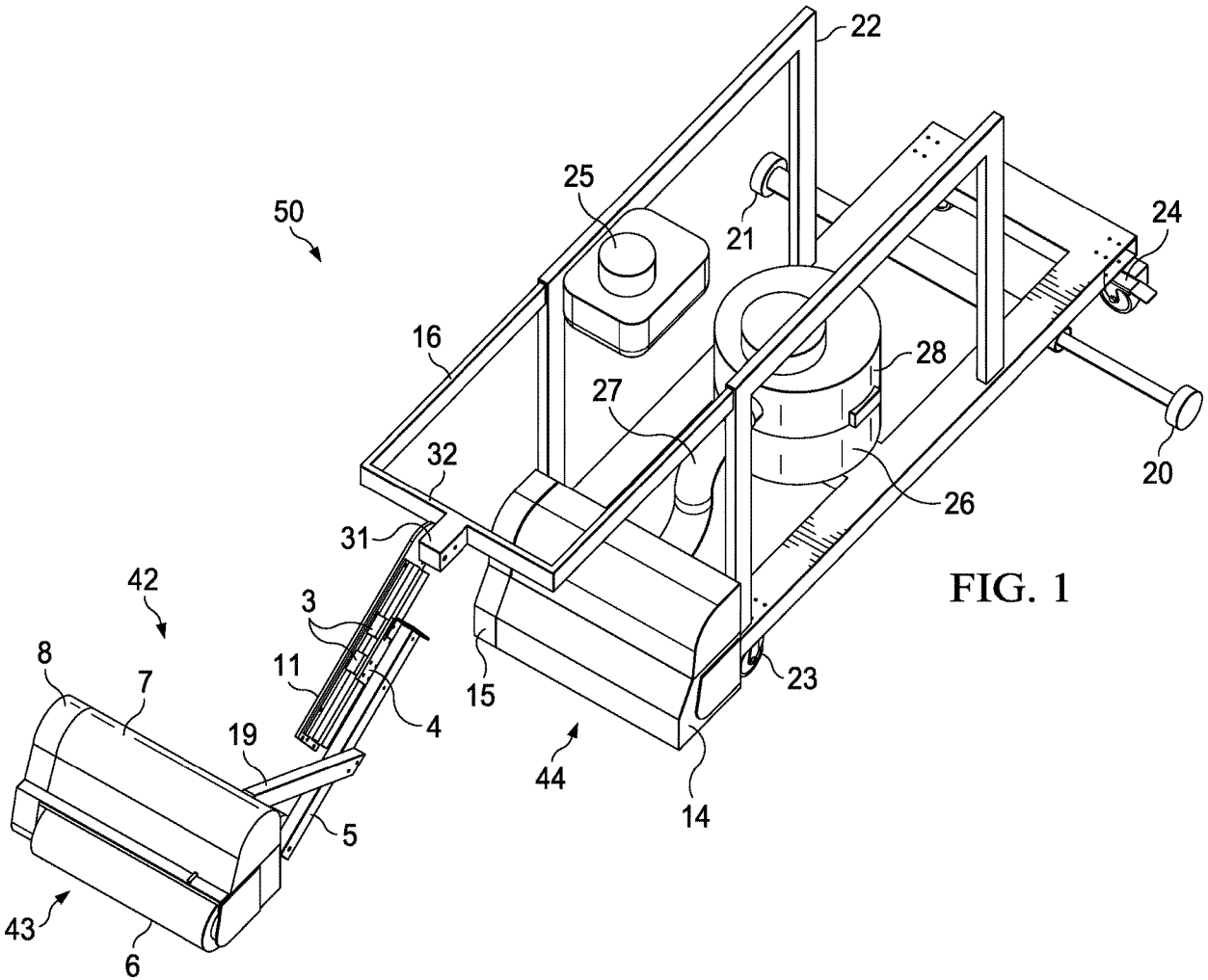
FIG. 1 is a forward perspective view of an exemplary embodiment of the herein disclosed servicing apparatus for an escalator or motorized stairway.

The features of the presently disclosed solution may be economically molded or assembled by using one or more distinct parts and associated components which, may be assembled together for removable or integral application with a conventional escalator, motorized stairway, or the like in an economical manner, wherein the features of the present disclosure may form the herein disclosed servicing apparatus regardless of the particular form. Unless defined otherwise, all terms of art, notations and other scientific terms or terminology used herein have the same meaning as is commonly understood by one of ordinary skill in the art to which this disclosure belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publication referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person. For example, the term "user" may refer to a person who uses the systems and methods described herein, and frequently may be a field technician. However, this term is not limited to end users or technicians and thus encompasses a variety of persons who can use the disclosed systems and methods.

"An escalator" is understood as any type of moving walkway or moving stairway that can include any number of steps with treads in a continuously moving manner of assembly with such escalators commonly being found in commercial centers such as malls, buildings, structures, or travel centers such as airports or train stations. Each step or portion of the walkway may be mounted, attached, or otherwise assembled on a cart in motion by being pulled by a continuously driven belt or chain. The escalator is known generally to be designed in a manner that moves passengers along successive movable stairs with opposing lateral edges.

The disclosed servicing apparatus and methods described herein resolve the foregoing problems and more. The herein described apparatus is easy to manufacture and can be adapted to currently known devices including escalators and motorized stairways thereby reducing the ultimate labor costs to service the same and improving safety for operators (e.g. field technician or facilities owners interesting in maintenance and/or repair) and the need to purchase special tools or expend great amounts of resources for otherwise normal maintenance.

While certain approaches are known to clean a bottom step portion of an escalator while the escalator is in motion, there are no solutions that reduce costs by servicing, cleaning, or otherwise maintaining riser and step portions of the escalator while the escalator is in motion. Furthermore, current approaches also fail to teach or describe servicing, cleaning, or otherwise maintaining some or all of a width of each step portion of the escalator while the escalator is in motion. In order to clean the riser step portion of the escalator with currently known solutions, it is necessary to deactivate the escalator and then manually adjust the position of the servicing device and even manually service, clean, or otherwise maintain the riser portion.

The herein disclosed servicing apparatus resolves this be imparting servicing systems that may automatically clean and polish an entire width of the escalator and/or both the step and riser portions of the escalators while the escalator is in motion and irrespective of the escalator size. The herein disclosed apparatus can perform with a single set-up procedure and servicing of both the step and riser portions may be done individually or simultaneously depending on need or preference.

The disclosed solution can now be better understood turning to the following detailed description. It is to be expressly understood that the illustrated embodiments are set forth as examples and not by way of limitations on the embodiments as ultimately defined in the claims. Turning to the drawings, FIG. 1 depicts a forward perspective view of an exemplary embodiment of the herein disclosed servicing apparatus 50. Apparatus 50 may include a support frame 22 having a base and one or more upright arm guides. A first service system 42 may be slidably received by the upright arm guides of frame 22 and a second service system 44 may be mounted to the forward end of the base of frame 22.

Frame 22 may be constructed from a variety of materials including metals, plastics, or the like, wherein frame 22 may be resilient and strong enough to mechanically support first 42 and second 44 services systems as well as any number of additional services systems or features as needed or required. Preferably, the base of frame 22 can be seen constructed in a generally rectangular shape but the shape of the base is not so limited and may take be constructed from any useful shape as needed or required. Alternatively, frame 22 may be a bored out container (instead of a separate frame and upright guide as in FIG. 1), a solid container, or any other type of construction.

System 42 may be designed to clean, maintain, or otherwise service each of the movable stairs of the escalator or motorized stairway while the stairs are in motion. More importantly, system 42 may be movable, freely or otherwise, relative to frame 22 between any number of planes, positions, and configurations to accommodate each step and riser portion of the escalator. System 44 may preferably be mounted to the base of frame 22 at the forward edge of the base. Optionally, system 44 could be positioned anywhere on frame 22 as needed or required. System 44 may be designed to service only the step portion or may be designed to service both the step and riser portion of each movable stair while the stairs are in motion or stationary, depending on needs or preference.

System 42 may include frame arm 16 that is slidably received by upright arm guide of frame 22. In a preferred embodiment, the upright arm guides of frame 22 may include multiple receivers and arm 16 may include multiple elongate members operable to be slidably inserted into respective receivers of the upright arm guide. Any number of receivers and elongate members of arm 16 may be included. Further, arm 16 may be slidably translatable between one or more predetermined positions along corresponding upright arm guides of frame 22 and may be designed to be fixed in place or freely move as system 42 moves between positions due to motion of the movable stairs.

In other embodiments, cross member 32 is attached between the set of upright arms. In these embodiments, frame arms 16 are eliminated.

Pivot arm 11 may be pivotally attached to pivot engagement 31 positioned on the forward edge of arm 16. Arm 11 may therefore be capable of pivoting, freely or otherwise, about engagement 31 and may be axially aligned with the forward edge of arm 16. Engagement 31 may be constructed from any known construction to impart pivotal movement to arm 11 such as a rotatable shaft or axle that may be removably attached or integrally formed with arm 16 itself. Engagement 31 may be axially aligned with other edges or rotatable features of apparatus 50 as needed or required so that system 42 results in being movable between planes, positions, and configurations to accommodate moving step and riser portions of the movable stairs.

Slide arm 5 may be slidably attached to arm 11 and may be slidable, freely or otherwise, between one or more predetermined positions as system 42 moves during use. Arm 5 in turn may be an elongate member that removably fastens to arm 11 through one or more bearing blocks 3 that reinforce engagement between arms 5 and 11 and an optional linear guide of arm 11. In practice, arm 5 may have a range of linear motion along the linear guide of arm 11 that spans between the distal portion of arm 11 until contacting, communicating, or being positioned adjacent to engagement 31.

System 42 may also include lever 19 with proximal and distal portions. The proximal portion of lever 19 may rigidly, pivotally, removably, or integrally attach to arm 5 and extend outwardly away therefrom. First servicing unit 43 of system 42 may be operatively and removably connected to the distal portion of lever 19 as discussed more particularly below. Between distal and proximal portions of lever 19 may be angle $\alpha$. Angle $\alpha$ may be any angle but preferably range between 90 and 180 degrees. Optionally, angle $\alpha$ may be adjustable between one or more predetermined angles such that the distal and proximal portions of lever 19 may be joined at a rotatable engagement similar to a ratchet so that angle $\alpha$ may be adjusted as necessary depending on need or preference.

In some embodiments, first servicing unit 43 is deployed as a set of interchangeable first servicing units 43 having various widths to accommodate various widths of movable stairs.

Arm 5 may also comprise rotatable guide 30 positioned on the distal portion of arm 5 underneath and/or away from unit 43. Preferably, guide 30 is disposed on a distal end of arm 5 furthest from arm 11. Guide 30 may be designed to rotate or otherwise translate along step and/or riser portions of any one of the movable stairs of the escalator while the stairs are in motion. Guide 30 may therefore be a wheel, shaft, or rounded elongated brushed member operable to dislodge undesired particulate lodged in the ridges or grooves of the step and/or riser portion. For example, one of the movable stairs may be in contact with guide 30 and but moving toward frame 22, wherein guide 30 may move and/or rotate along the step portion opposite the direction of the moving stair until contacting the subsequent riser portion. When guide 30 is caused to contact the riser portion in this regard, guide 30 may then automatically move and/or rotate upwards along the riser portion until contacting or otherwise communicating with the subsequent step portion of the movable stairs. As guide 30 moves upwards along the riser portion, the corresponding service unit 43 that is operatively connected to the distal portion of lever 19 which is connected to arm 5 may be caused to move between planes, positions, and configurations. This action is automatic since it requires no manual input from a user or technician to impart proper maintenance. In turn, this configuration trims labor costs for maintenance of the escalator or motorized stairway.

Unit 43 may include a sprayer system in communication with the distal portion of lever 19, wherein the sprayer system is designed to distribute liquid chemical solution on the stairs while they are in motion. The sprayer system may include a spray nozzle designed to distribute a predetermined amount of liquid solution from a pressurized tank of fluids or external fluid source such as tank 25. The liquid solution may be distributed by being sprayed, poured, misted, or otherwise delivered in a manner to effectively coat, partially or completely, the riser and/or step portion of the movable stairs while they are in motion. The sprayer system of unit 43 may be designed to periodically deliver the liquid solution (e.g. in some interval of time) or continuously deliver the liquid solution to the stairs. The sprayer system may include an activation button operable to receive instructions from an operator such as a trigger that causes the liquid solution to be released from the sprayer system itself. Optionally, the sprayer system may be designed to automatically deliver the liquid solution depending on the particular escalator or motorized stairway being serviced.

Unit 43 may also comprise a motor 8 in communication with a brush system 6, wherein system 6 may be designed to remove particulate, dirt, waste or other undesirable materials from the step and riser portions of each movable stair. In this respect, unit 43 may include motor cover 7 designed to shield motor 8. System 6 may include a rounded, rotatable elongated brushed member axially connected to motor 8 so that the rotatable elongate brushed member is capable of being rotated, continuously or intermittently, by motor 8. Preferably, the brushed member of system 6 is cylindrical with a plurality of resilient and/or flexible brushes but the design is not so limited and may take any reasonable form depending on need or preference. When the brushed member of system 6 is moved and/or rotated along a corresponding movable stair, contact of the brushed member in this manner forcibly removes and/or dislodges unwanted material that may already be loosened by the previously-described sprayer system. Motor 8 may be directly connected to an external power supply or may be powered through a local battery of apparatus 50.

Second service system 44 of FIG. 1 is removably connected to frame 22 and may also include a second motor 13 in communication with a second brush system 2. Similar to system 6, system 2 may include a rounded, rotatable elongate brushed member axially connected to motor 13 so that the rotatable elongate brushed member is capable of being rotated, continuously or intermittently, by motor 13. Preferably, the brushed member of system 2 is cylindrical with a plurality of resilient and/or flexible brushes positioned within or inside cover 14. Motor 13 may likewise be disposed inside of or in communication with cover 14. However, the design of system 44 is not so limited. System 2 including each of cover 14, motor 13 and its corresponding brushed member may take any reasonable form depending on need or preference. In practice, when the brushed member of system 2 is moved and/or rotated along a corresponding movable stair, contact of the brushed member may forcibly remove and/or dislodge unwanted material that may already be loosened by the previously-described sprayer system. Similar to motor 8, motor 13 may be directly connected to an external power supply or may be powered by a local battery of apparatus 50. Motor 13 may be positioned in any arrangement. For example, motor 13 may be positioned adjacent to brush 6 in front or back of brush 6. Any number of motors may be employed.

In some embodiments, second service system 44 is deployed as a set of interchangeable second service systems 44 having various widths to accommodate various widths of movable stairs.

Figure 2:
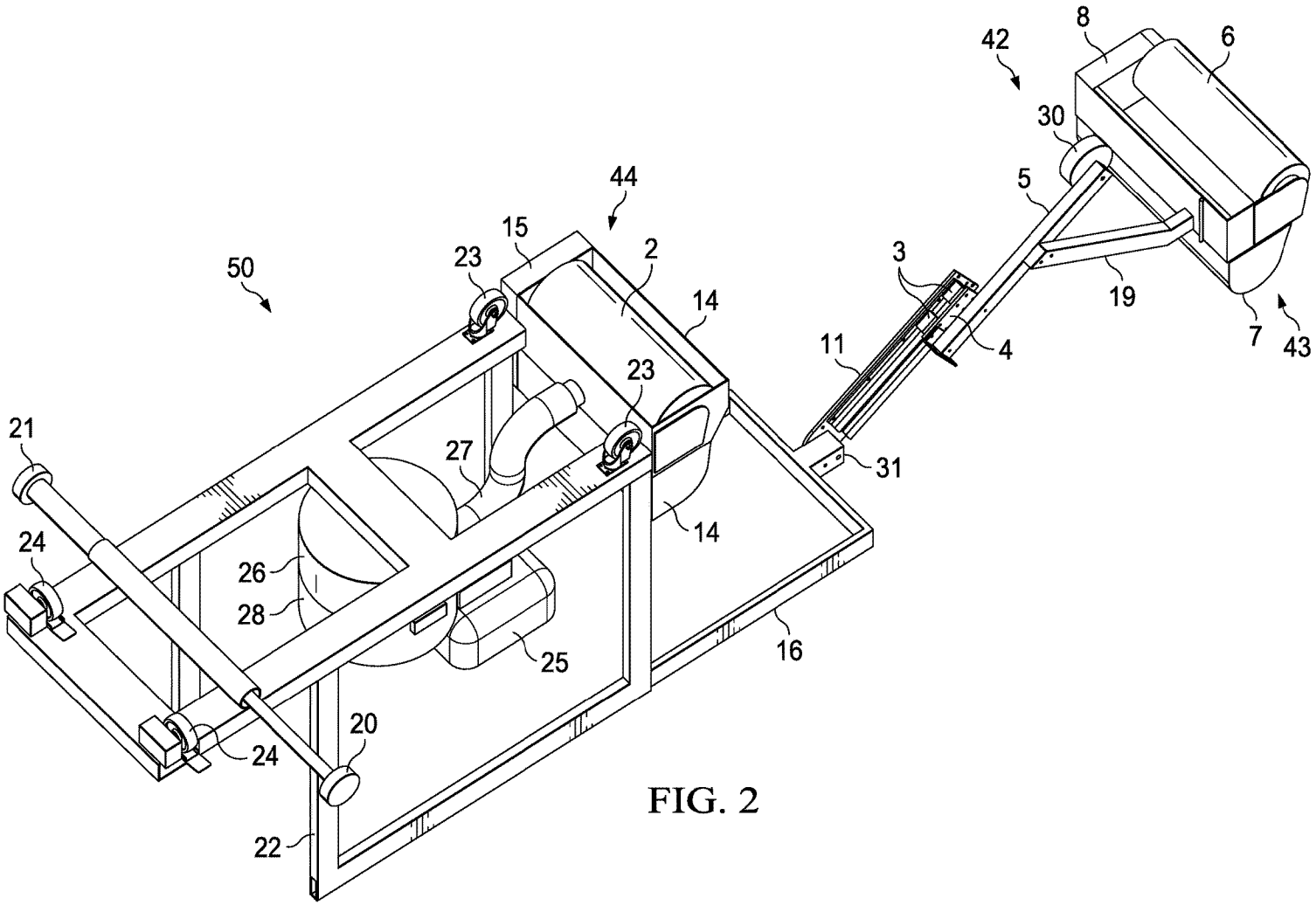
FIG. 2 is a rear perspective view of the apparatus of FIG. 1, wherein the apparatus is oriented so the underside of the apparatus is visible.

Turning to FIG. 2, apparatus 50 can be seen re-oriented so the underside of the frame 22 is visible. As can be seen moving between FIGS. 1 and 2, a vacuum system 28 may be disposed inside of frame 22 in fluid communication with system 44 through hose 27. System 28 may comprise an internally positioned motor (not depicted) or optionally, the motor of system 28 may be located elsewhere in apparatus 50. System 28 is designed so that its motor causes fluids and other undesired waste or particulate dislodged by system 44, system 42, or otherwise in communication with the movable stairs is caused to be drawn from system 44 through hose 27 into vacuum container 26 for later disposal. Hose 27 may be operatively connected to cover 14 (See FIG. 2) or may connected to its own nozzle depending on need or preference. In some embodiments, vacuum system 28 is a compact vacuum and attached to the inside of cover 14 adjacent to brush 6.

As can be seen in FIGS. 1 and 2, the base of frame 22 may be supported by a plurality of support wheels 23 and 24. Preferably, wheels 23 and/or 24 may be swivel wheels capable of being moved in a plurality of different directions for easy translation of apparatus 50 during and between use. Any number of wheels 23 and 24 may be removably attached or integrally formed with apparatus 50 at any number of locations as needed or required. Preferably, a pair of wheels 23 may be removably attached to the forward edge of the base of frame 22 adjacent to or near system 44 and a pair of wheels 24 may be removably attached to the rear edge of the base of frame 22. Each of wheels 23 and 24 may be constructed having from rubber, plastic, nylon, metal or the like, or some combination thereof.

In one embodiment, apparatus 50 may also include a locking mechanism designed to releasably secure frame 22 of apparatus 50 to guide rails of the escalator or motorized stairway. In practice, apparatus 50 may be positioned at the entrance of the escalator wherein once system 44 is properly positioned over the corresponding step portion of the movable stairs, the locking mechanism functions to secure the apparatus 50 from moving forward or rearward. Preferably, the locking mechanism includes elongate members 21 and 20 that can be seen in FIGS. 1 and 2 extending outwardly from frame 22. Member 20 may be slidably inserted, freely or otherwise, into member 21. In this respect, member 20 may be slidable between one or more predetermined positions to adjust the distance between the distal ends of members 20 and 21. In some embodiments, it is preferred that members 20 and 21 be locked in place on the corresponding escalator or motorized stairway to optimize stability of apparatus 50 during use. Distal ends of members 20 and 21 may include a removable fastener such as a plunger constructed from materials such as plastic, rubber, and polymers as well as a bolt, pin, or other such fastening element to impart removable attachment to any conventional guide rail of an escalator. It is also contemplated that the locking mechanism of apparatus 50 may include a single elongated member with opposing ends operable to contact or otherwise secure apparatus 50 thereto. Optionally, magnetic fasteners, including electromagnetic fasteners, may be positioned on the distal ends of members 20 and 21. Apparatus 50 may also comprise one or more externally positioned suction cups to securely engage with the escalator or motorized stairway to provide both indexing motion as well as optimized stability. Moreover, apparatus 50 may service the corresponding movable stairs through vacuum system 28 and services systems 42 and 44 automatically and without need for laborious manual re-positioning of apparatus 50 during the applicable service, maintenance, cleaning or the like.

Figure 3:
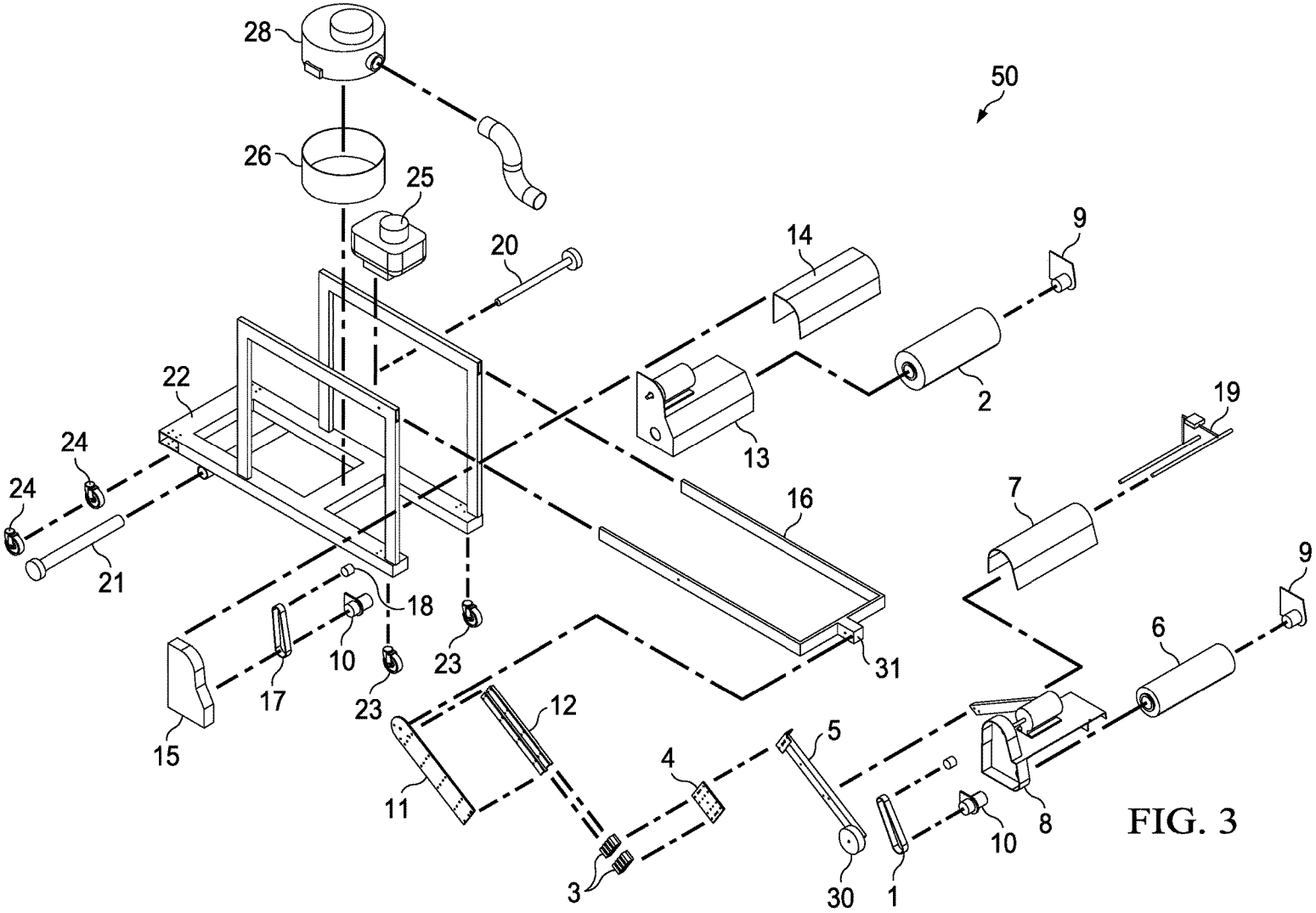
FIG. 3 is an exploded perspective view of certain individual features of the apparatus of FIG. 1.
Figure 4:
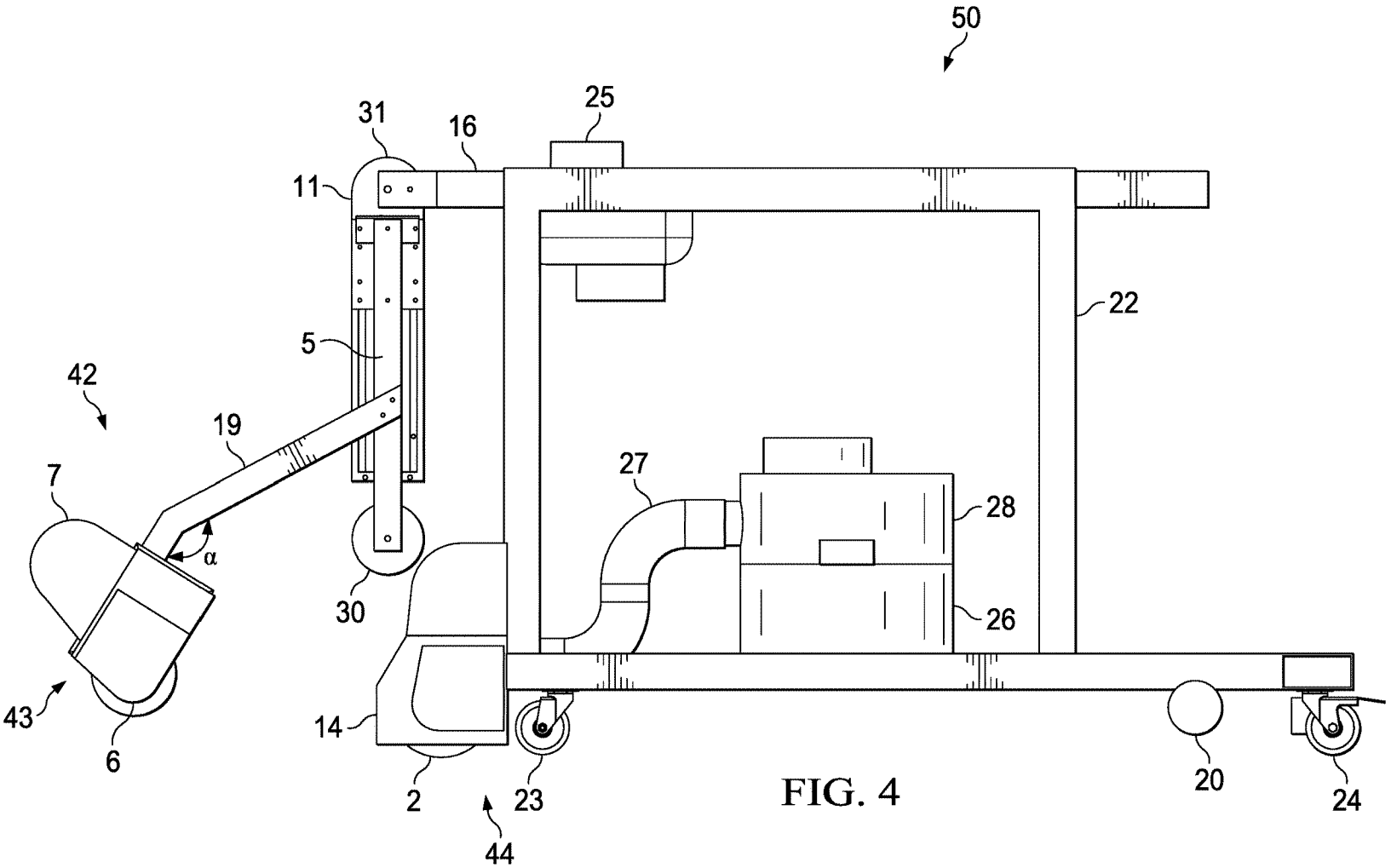
FIG. 4 depicts a side view of the apparatus of FIG. 1, wherein the first service system of the apparatus is depicted in a retracted state.
Figure 5:
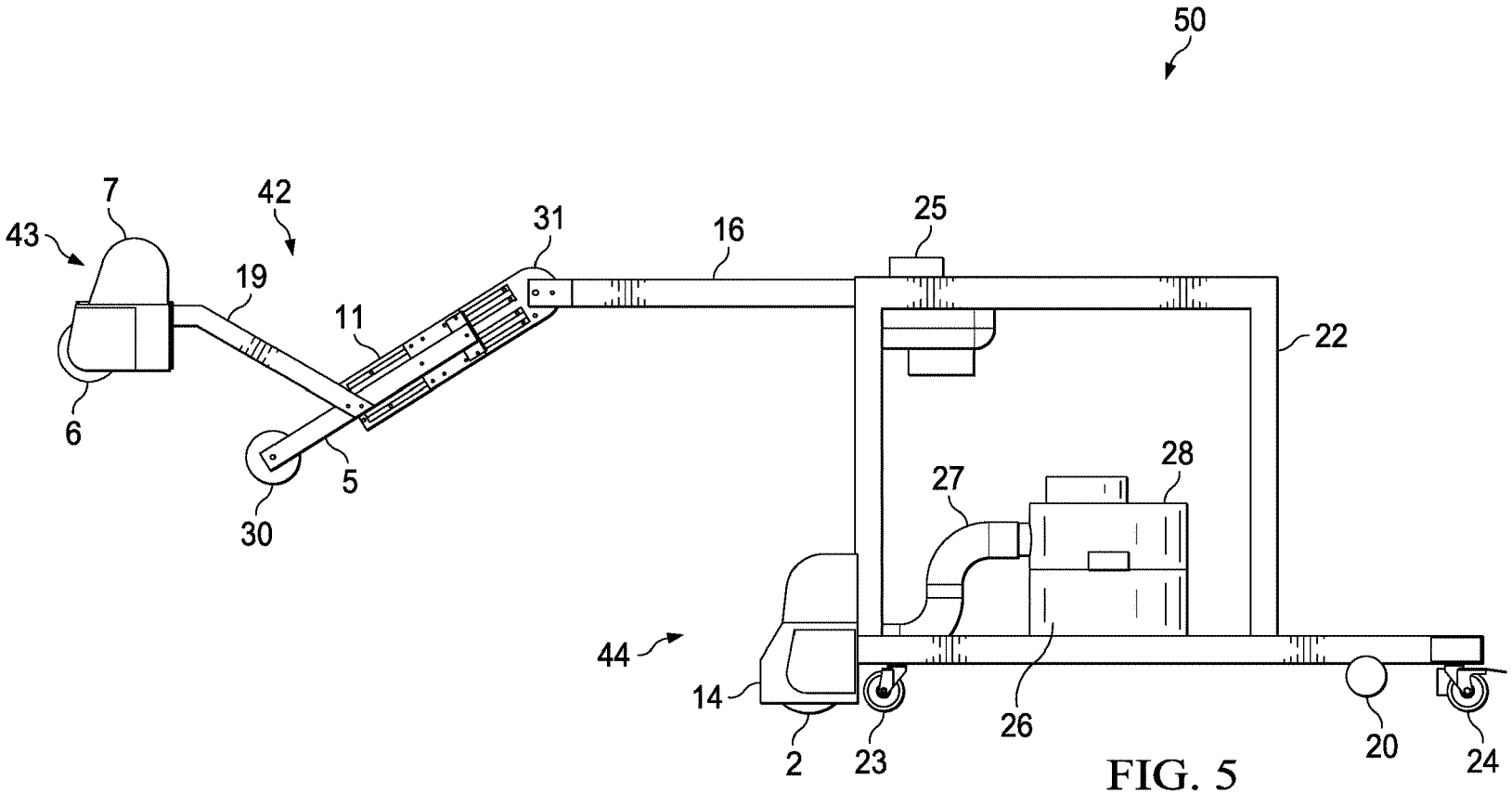
FIG. 5 depicts a side view of the apparatus of FIG. 1, wherein the first service system of the apparatus is depicted in an extended state.

Turning to FIG. 3, the apparatus 50 can be seen depicted in an exploded state with the previously described features of FIGS. 1 and 2. FIGS. 4 and 5 depict a side view of apparatus 50, wherein system 42 is shown moving between a retracted state in FIG. 4 and an extended state which includes a raised position in FIG. 5. Comparing the extended and retracted states of FIGS. 4 and 5 demonstrate how arm 11 pivotally moves about engagement 31 and arm 16 may be slidably adjusted as the remaining corresponding features of system 42 are caused to move between the plurality of positions, planes and configurations. In this respect, it can be more clearly understood how in a retracted state of FIG. 4, arm 16 is slidably inserted into the corresponding upright rail guide of frame 22 at its innermost position and arm 11 is oriented generally perpendicular to the ground surface on which apparatus 50 may be situated. In contrast, FIG. 5 in the extended state depicts arm 16 slidably adjusted to extend away from frame 22 so that arm 16 and corresponding engagement are positioned at their outermost configurations. Likewise, arm 11 has pivoted about engagement 31 and rotated approximately 45 degrees relative to FIG. 4 thereby causing guide 30 and unit 43 to be raised.

Figure 6:
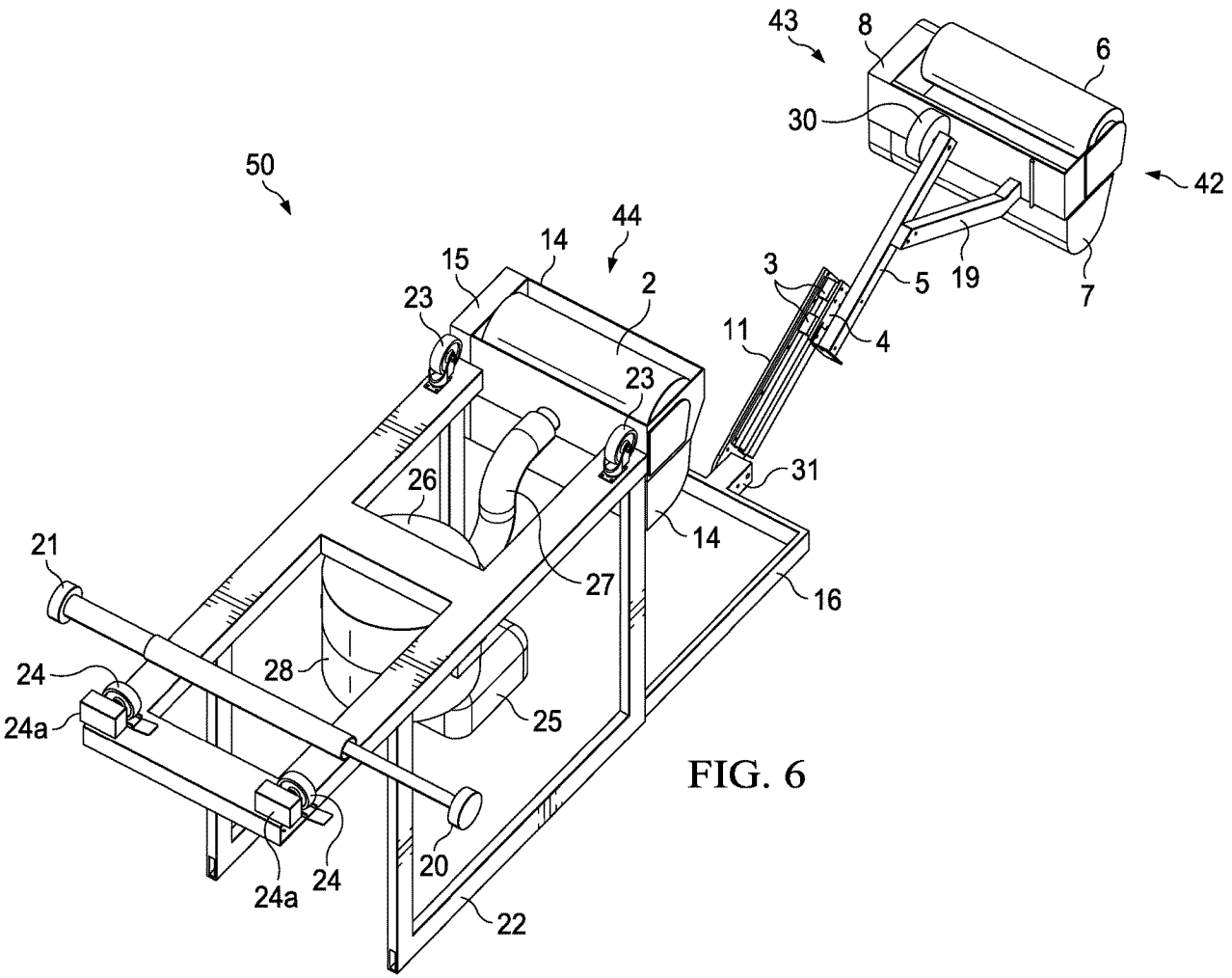
FIG. 6 is a rear perspective view of the apparatus of FIG. 1, wherein the apparatus is oriented so the underside of the apparatus is visible and the locking mechanism of the apparatus is depicted in the extended state.
Figure 7:
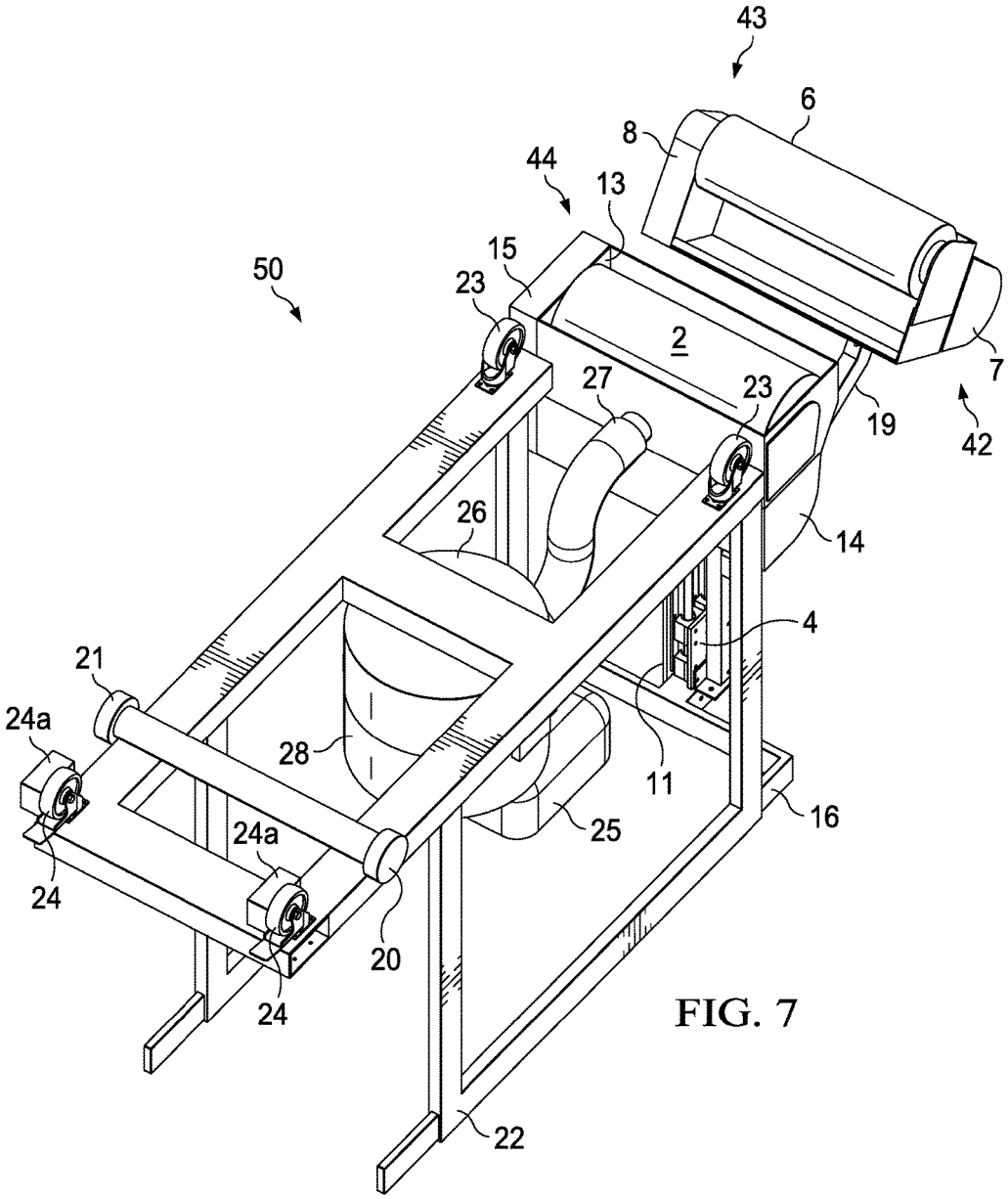
FIG. 7 is a rear perspective view of the apparatus of FIG. 1, wherein the apparatus is oriented so the underside of the apparatus is visible and the locking mechanism of the apparatus is depicted in the retracted state.

This motion will be more clearly understood by turning to FIGS. 6 through 10. More particularly, FIGS. 6 and 7 depict the previously described principles of operation between retracted and extended states but with apparatus 50 depicted in a rear perspective view. Specifically, FIG. 6 depicts apparatus 50 in its extended state and FIG. 7 depicts apparatus 50 in its retracted state. Wheels 24 in FIG. 6 may optionally comprise motorized or manual wheel locks **24*a* for locking wheels 24 to provide side to side motion when apparatus 50 is in an extended state. By contrast, locks 24*a* in FIG. 7 can be seen having now been rotated 90 degrees so that side to side motion is no longer permissible. In FIG. 7, apparatus 50 may now be transported onto or away from a corresponding motorized stairway or escalator. The design of FIGS. 6 and 7 is not so limited however. Similar locks 24*a*** may be provided with wheels 23 or in other locations on apparatus 50 as desired or needed.

In practice, a user may orient locks 24*a* similar to the position of FIG. 7 until apparatus is positioned as desired with a motorized stairway or escalator. Once positioned, locks 24*a* may be manually or automatically oriented so that side-to-side indexing motion is possible as per FIG. 6.

The locking mechanism of apparatus 50 and its corresponding members 20 and 21 can be seen also moving between extended and retracted positions as the length between the opposing distal ends of each member 20 and 21 is adjusted depending on the corresponding width of the escalator or motorized stairway.

Figure 8:
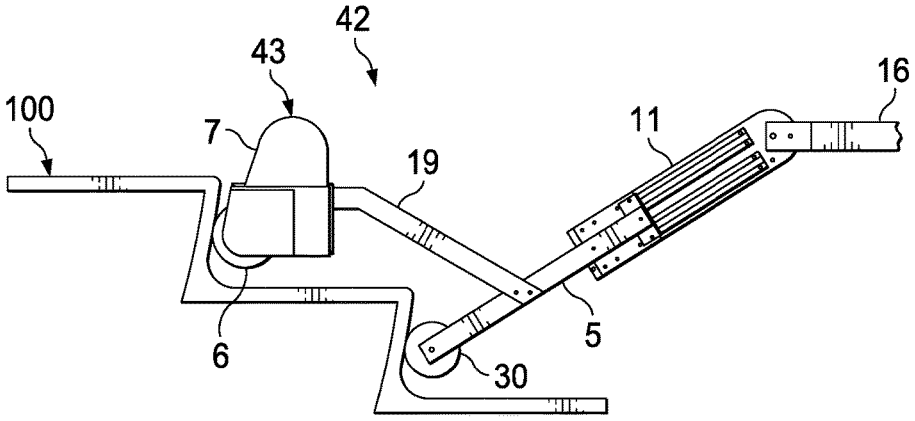
FIG. 8 depicts a side view of certain features of one embodiment of the first service system of the apparatus of FIG. 1 in communication with riser portions of an escalator.
Figure 9:
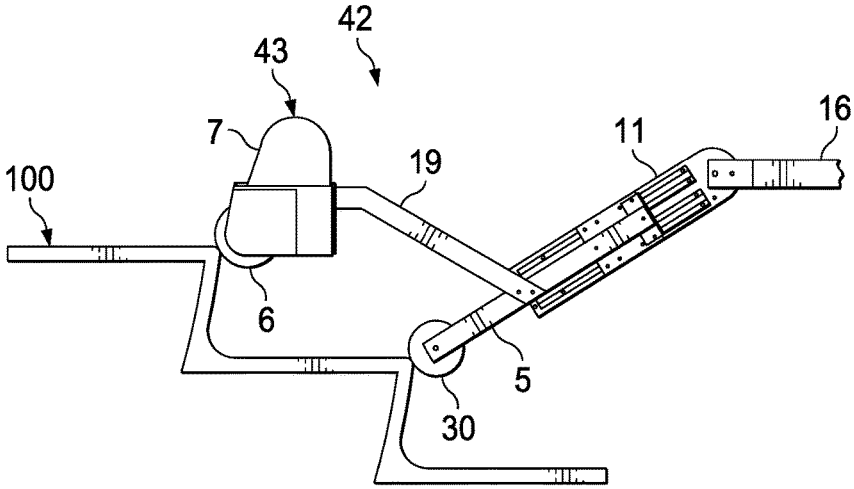
FIG. 9 depicts a side view of certain features of another embodiment of the first service system of the apparatus of FIG. 1 in communication with riser portions and step portions of an escalator.
Figure 10:
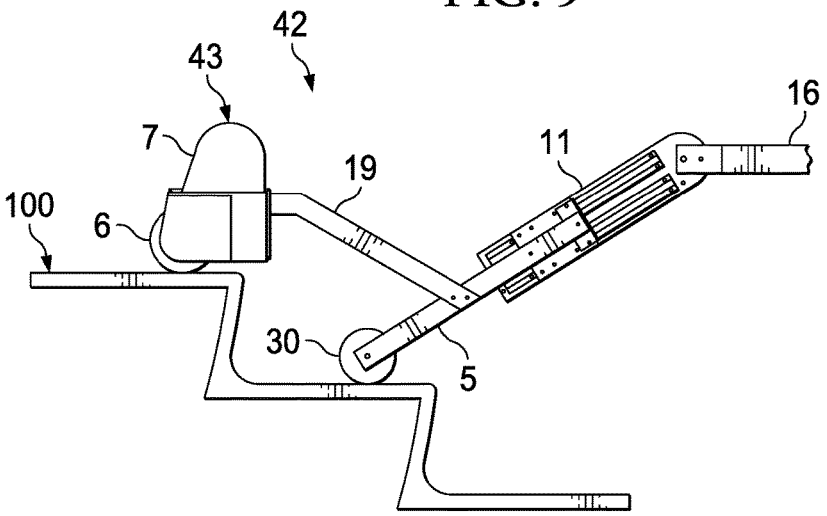
FIG. 10 depicts a side view of certain features of another embodiment of the first service system of the apparatus of FIG. 1 in communication with step portions of an escalator.

FIGS. 8 through 10 depict exemplary side views of system 42 as it moves along the movable stairs of exemplary escalator 100 when apparatus 50 is in use. In FIG. 8 for example, guide 30 is in communication with the riser portion of the lowest stair in the movable stairs of escalator 100. Unit 43 in turn is depicted contacting the riser portion of the subsequent movable stair above guide 30. As the lowest and subsequent stairs move while escalator 100 is in motion, apparatus 50 remains secured in place, for example, by locking mechanism and corresponding members 20 and 21 securely engaging with the guide rails of escalator 100 (not depicted). Because apparatus 50 may be secured in place, movement of the lowest and subsequent stairs of escalator 100 causes unit 43 and corresponding guide 30 to move along associated riser portions towards the edge of each respective stair (FIG. 9) and ultimately the subsequent step portion, respectively (FIG. 10). It can be seen that system 6 may be capable of following the motion of exemplary escalator 100 for precise control irrespective of escalator 100 velocity, geometry, or direction; since, for example, springs which may be provided in arm 11 can guide system 6 along each of the moving stairs 100.

As apparatus 50 moves between each movable stair in FIGS. 8-10, apparatus can be seen moving between retracted and extended states defined by any number of positions, planes, and/or configurations. As apparatus 50 moves between these positions, planes, and/or configurations, corresponding systems 42, 44, and 28 may automatically clean, maintain, dislodge unwanted particulate, and otherwise service each of the movable stairs of exemplary escalator 100.

Figure 11:
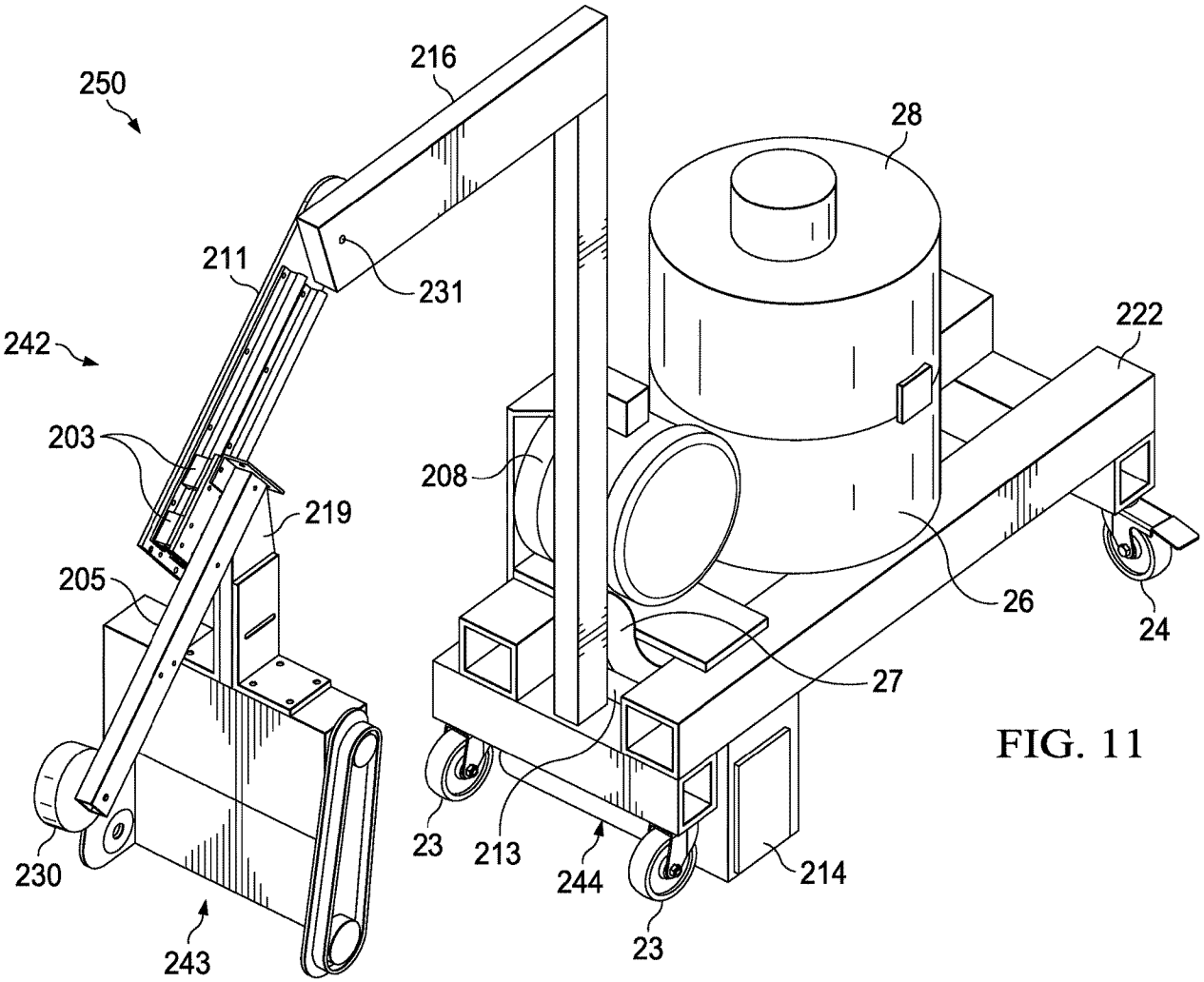
FIG. 11 is a forward perspective view of another exemplary embodiment of the herein disclosed servicing apparatus for an escalator or motorized stairway with a modified frame and related service systems.

FIGS. 11 through 14 depict another embodiment of apparatus 250 similar to the previously described apparatus 250, wherein it should be noted that features with similar numeric designations (e.g. system 42 and 242) correspond to modified versions of previously described features and systems in FIGS. 1-10. More specifically, FIG. 11 depicts a forward perspective view of apparatus 250 with frame 222 having a rectangular base and a single upright arm guide (versus the multiple guides that are possible in FIG. 1). System 242 may be slidably received by the single upright arm guide of frame 222 and/or may be pivotally, rigidly, or otherwise attached to arm 216 at engagement 231. It can also be seen that frame arm 216 of FIG. 11 is constructed from a single elongate member capable of being slidably inserted into the single upright arm guide of frame 222.

Optionally, arm 216 may be rigidly connected to the single upright arm guide of frame 222 or pivotally connected thereto so that it can pivot between use and stowed configurations. During the use configuration, arm 216 would pivotally connect so that system 242 is extended forward of the forward edge of frame 222 as is the case in FIG. 11. By contrast, in the stowed configuration, arm 216 can be moved or pivoted so that system 242 is now disposed adjacent the opposite rear edge of frame 222.

Similar to system 42, system 242 may be movable, freely or otherwise, relative to frame 222 between any number of planes, positions, and configurations to accommodate the corresponding step and riser portions of the escalator. Pivot arm 211 of apparatus 250 may be pivotally attached to engagement 231 so that arm 211 can pivot, freely or otherwise, about engagement 231 along arm 216. A slide arm 205 may slidably attach to arm 211 and be slidable between one or more predetermined positions as system 242 moves with the riser and step portions of escalator 100 during use.

System 242 may also comprise lever 219. Lever 219 differs from previously described lever 19 in that lever 219 extends downward and away from corresponding arms 205 and 211. Lever 219 may be a single elongate member having distal and proximal portions, or may be a machined plate with distal and proximal portions and removable fasteners operable to fasten to both first servicing unit 243 and arms 205 and 211.

In some embodiments, first servicing unit 243 is deployed as a set of interchangeable first servicing units 243 having various widths to accommodate various widths of movable stairs.

Motor 213 may be positioned in any arrangement. For example, motor 213 may be positioned adjacent to brush 206 in front or back of brush 206. Any number of motors may be employed.

In some embodiments, second service system 244 is deployed as a set of interchangeable second service systems 244 having various widths to accommodate various widths of movable stairs.

In some embodiments, vacuum system 28 is a compact vacuum and attached to the inside of cover 214 adjacent to brush 206.

Figure 12:
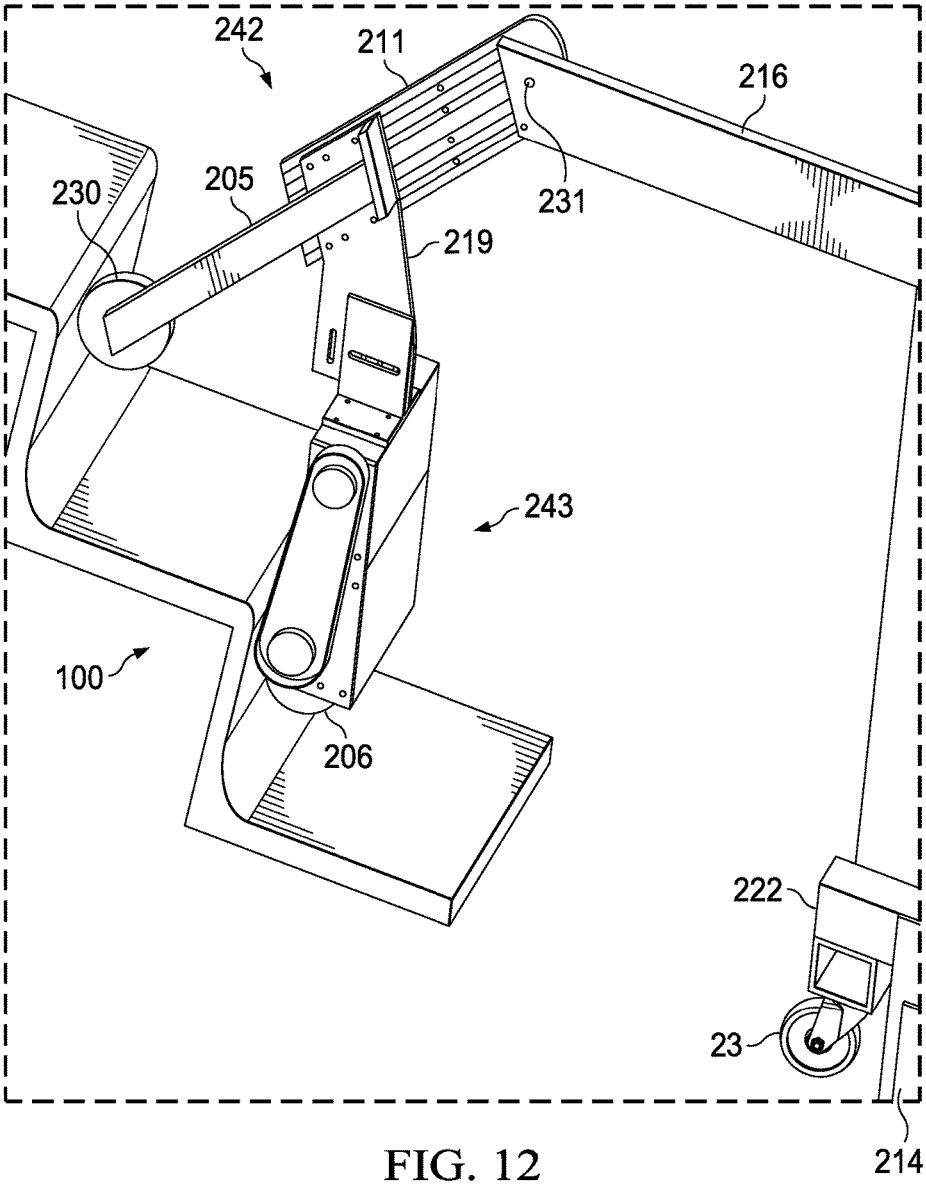
FIG. 12 is a side perspective view of the embodiment of FIG. 11 in communication with riser portions of an escalator.

FIG. 12 depicts an exemplary side perspective view of system 242 as it moves along corresponding movable stairs 100, wherein because apparatus 250 may be secured in place movement of the lowest and subsequent stairs of escalator 100 may cause unit 243 and corresponding rotatable guide 230 to move along associated riser portions towards the edge of each respective stair. It can be seen that apparatus 250 has the design flexible to orient system 243 so that it is disposed behind rotatable guide 230 during use (as opposed to rotatable guide 30 being behind system 43 in FIGS. 8 through 10).

Similar to apparatus 50, apparatus 250 may also comprise a locking mechanism designed extend outwardly from frame 222 to secure apparatus 250 to the escalator 100. As previously stated, the locking mechanism of apparatus 50 can include members 20 and/or 21 that may be adjusted and/or fixed in place so as to securely engage the apparatus 50 with the corresponding guide rails of escalator 100. Apparatus 50 in this respect is capable of laterally indexing or translating along wheels 24 or optionally members 20 and 21. Apparatus 250 may also contain a locking mechanism with members 20 and 21 or may contain an optional locking mechanism constructed with members 220 and 221 as explained more specifically in FIGS. 13*a* and 13*b*.

Figure 13B:
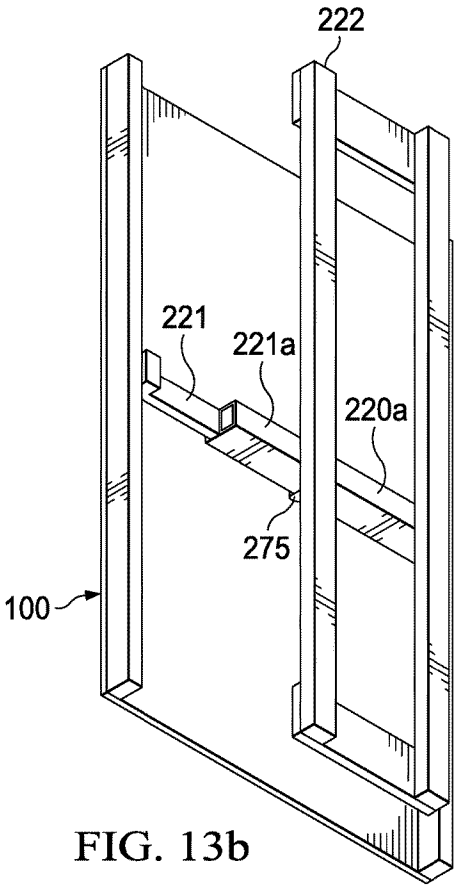
FIG. 13*b* depicts an optional locking mechanism for the embodiments of FIGS. 1-12, wherein the indexing mechanism is oriented adjacent to a second side of an exemplary escalator.
Figure 13A:
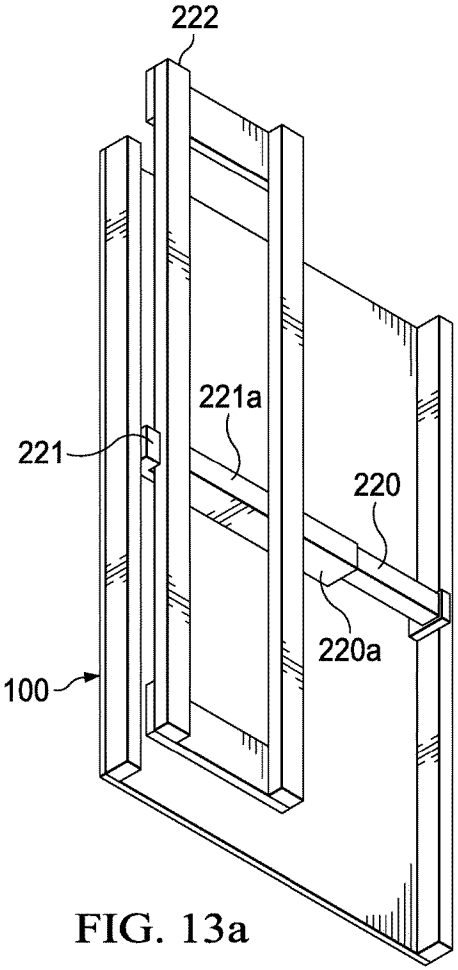
FIG. 13*a* depicts an optional locking mechanism for the embodiments of FIG. 112, wherein the indexing mechanism is oriented adjacent to a first side of an exemplary escalator.

It is to be understood that apparatus 250 would be mounted to or otherwise seated atop frame 222 in both FIGS. 13*a* and 13*b*. More specifically, FIG. 13*a* shows the locking mechanism capable of lateral indexing and oriented so that the frame 222 is adjacent to a first side of escalator 100 near the guide rail so that corresponding apparatus 250 would be positioned to service the first side of escalator 100 and corresponding stairs. FIG. 13*b* shows the same locking mechanism of FIG. 13*a* but frame 222 has now laterally indexed along escalator 100 towards a second side of escalator 100 near an opposing guide rail. Locking mechanism may be mounted or coupled to the underside of frame 222, wherein members 220 and 221 may be slidably received by corresponding receiver guides 220*a* and 221*a* or a single receiver guide such as guide 220*a* or 221*a*. In this respect, members 220 and 221 may be internally housed in guides 220*a* and/or 221*a*, wherein guides 220*a* and/or 221*a* may be bored out sleeves, housings or the like. Alternatively, members 220 and 221 may be externally positioned without guides 220*a* and/or 221*a* directly underneath apparatus 250 and preferably underneath frame 222.

Figure 14:
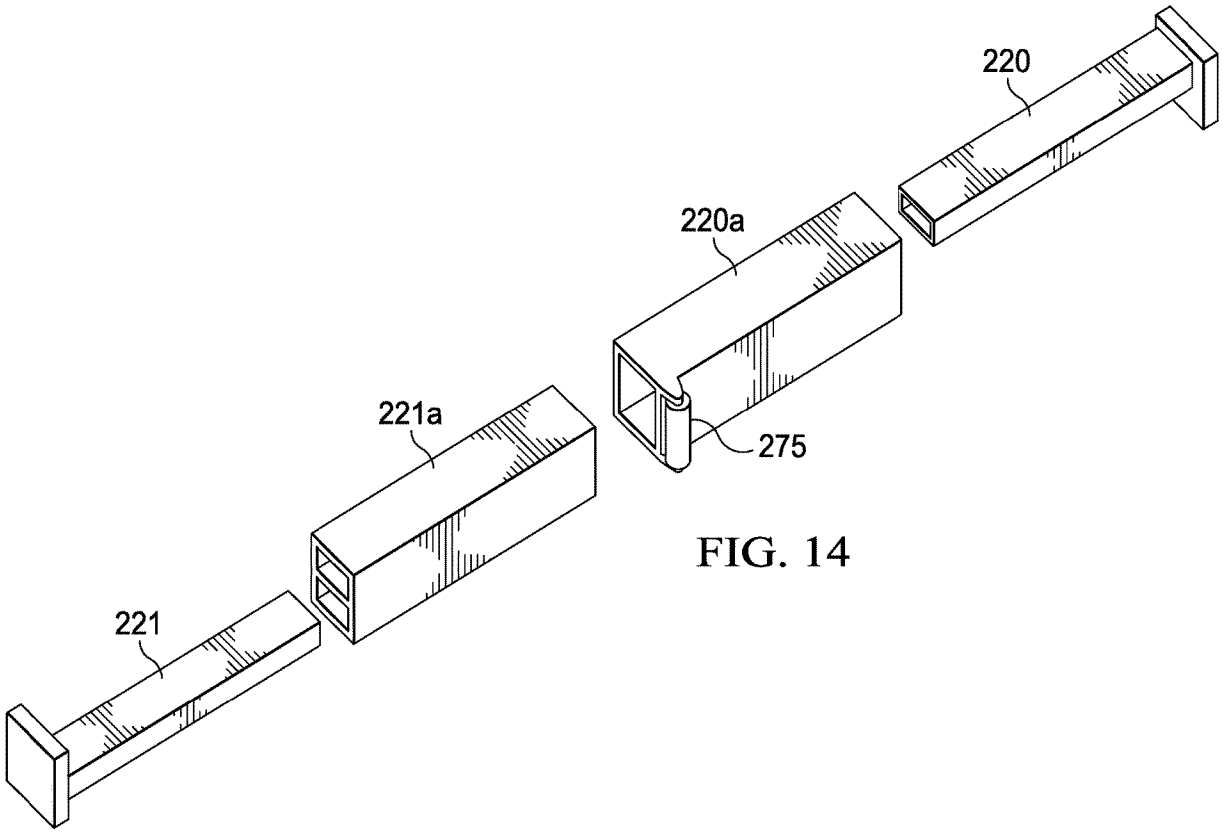
FIG. 14 depicts an exploded view of the locking mechanism of FIGS. 13*a* and 13*b*.

FIG. 14 depicts an exploded view of locking mechanism of FIGS. 13*a* and 13*b*, wherein member 221 can be seen prior to being slidably received by a guide such as guide 220*a* or 221*a*. Likewise, member 220 can be seen prior to being slidably received by a guide such as guide 220*a* or 221*a*. A support wheel for easy translation and/or lateral indexing motion of apparatus 250 may be positioned anywhere on the locking mechanism including underneath or adjacent to guides 220*a* or 221*a*. Optional guide wheel 275 may be provided in those embodiments where both guides 220*a* and 221*a* are included to facilitate lateral indexing and translation of guides 220*a* and 221*a*. In a preferred embodiment, guide 221*a* may receive both members 220 and 221, wherein members 220 and 221 extend outwardly away from each other until securely engaging the guide rails of escalator 100. Once securely engaged, guide 220*a* may then laterally translate frame 222 along guide 221*a* between opposing guide rails of escalator 100 using wheel 275. The design is not so limited, however, and guide 221*a* or guides 220*a* and 221*a* together may be designed to receive both members 220 and 221 and/or be translatable laterally between opposing sides of escalator 100. Furthermore, certain embodiments may not require wheel 275 and instead slide without aid of wheel 275 or may alternatively utilize frictionless bearings, slides or other similar track systems that encourage lateral translation.

Side-to-side indexing motion of frame 222 of apparatus 250 may be accomplished by positioning one or more support wheels under or adjacent to members 220 and/or 221 (e.g. removably attached to guides 220*a* and/or 220*b*). The one or more support wheels may be turned together, or independently, through an additional drive motor, brush motor 208 or through motor 213 of system 244. The additional drive motor, brush motor 208 or motor 213 may transmit incremental pulses to the one or more support wheels for controlling and turning, individually or simultaneously, so that apparatus 250 may index side-to-side at a predetermined rate. As such, apparatus 250 can be caused to laterally translate along members 220 and/or 221 to both stabilize and impart indexing translatability to apparatus 250.

It should be understood that apparatus 250 may only include a single wheel, including either wheels 23 and/or 24, to achieve the described indexing motion. Additionally, one or more indexing wheels may be released from underneath the bottom of frame 22 of apparatus 50 in a manner similar to landing gear being deployed from an aircraft.

Advantageously, apparatus 50 and 250 may be laterally translatable along the entire width of the corresponding movable stairs. In other words, locks 24*a*, members 20 and 21, or members 220 and 221 may serve to stabilize apparatus 50 or 250 and impart indexing capabilities between a plurality of positions. Whether positioned as depicted in FIGS. 1-7 in the upper portion of frame 22 or connected to the underside of frame 222 as is the case in FIGS. 13-14, apparatus 50 and 250 may translate any distance between positions for ease of orienting apparatus 50 and 250 within the motorized stairway or escalator 100. However, the design is not so limited and arm 16 or 216, members 20 and 21, or members 220 and 221 may be translatable any distance required or preferred according to particular applications. In practice, once members 20 and 21 or 220 and 221 are positioned in the selected location to optimize stability of apparatus 50 or 250, the user may then initiate servicing of the escalator or motorized stairway 100.

When members 20 and 21 or members 220 and 221 are used with respective locking mechanisms to secure apparatus 50 or 250 with guide rails of a corresponding escalator or motorized stairway 100, apparatus 50 or 250 is particularly advantageous since it is capable of imparting side-to-side indexing motion along moving riser and step portions of any movable stair. In other words, while a particular escalator or motorized stairway is being serviced, apparatus 50 is capable of translating incremental distances to sides or locations opposite its starting position. Moreover, apparatus 50 may laterally translate incremental distances automatically which in turn reduces the underlying labor costs previously associated with re-positioning or re-configuring cleaning tools during servicing of escalators or motorized stairways. By reducing these labor costs, it is forecasted that workers compensation claims related to fatigue or incidental injury, cleaning and maintenance standards will become more consistent, fewer maintenance employees will be required.

Apparatus 50 or 250 may also comprise a user interface. The user interface may be directly connected and/or mounted on apparatus 50 itself or be wirelessly connected thereto. In those embodiments when the user interface is directly connected, it may include one or more buttons or knobs or it may be integrated into an LED screen with capacitive sensors. The user interface may include an activation switch for the entire apparatus 50 as well as on/off switches, rotational speed, and speed associated with systems 43 and 44. Additionally, the user interface may include controls directed towards automatic or manual release of solution from the sprayer nozzle of either of systems 43 or 44, actuation control over vacuum system 28, or indexing control over apparatus 50 itself including by adjustment of frequency and strength of pulses imparted to the one or more indexing wheels.

Figure 15:
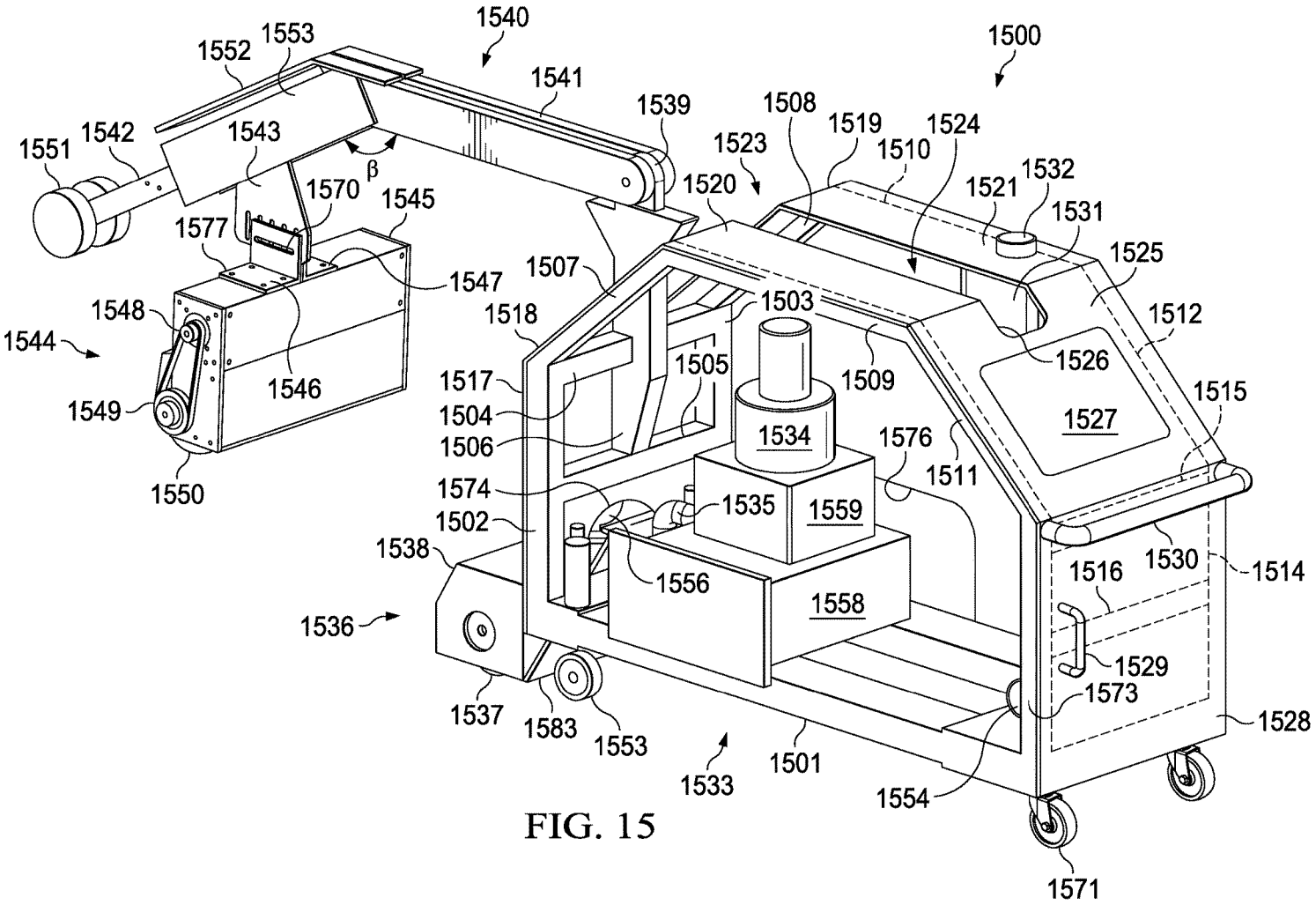
FIG. 15 depicts an isometric view of a servicing apparatus of another embodiment.

Referring to FIG. 15 in another embodiment, apparatus 1500 includes base frame 1501, supports 1502 and 1503 attached to base frame 1501, and cross-members 1504 and 1505 attached to supports 1502 and 1503. Arm support guide 1506 is attached to cross-members 1504 and 1505. Angled supports 1507 and 1508 are attached to cross-member 1504. Cover supports 1509 and 1510 are attached to angles supports 1507 and 1508, respectively. Angled supports 1511 and 1512 are attached to cover supports 1509 and 1510, respectively. Supports 1513 and 1514 are attached to angled supports 1511 and 1512, respectively, and to base frame 1501. Sets of wheels 1553 and 1571 support base frame 1501. Locking mechanism 1554 is optionally mounted to base frame 1501.

Panel 1517 is attached to supports 1502 and 1503 and to cross-members 1504 and 1505. Panel 1517 includes access hole 1574 integrally formed therein. Panel 1518 is attached to angled support 1507 and to cross-member 1504. Panel 1519 is attached to angled support 1508 and to cross-member 1504. Slot 1523 separates panels 1518 and 1519. Cover panels 1520 and 1521 are attached to cover supports 1509 and 1510, respectively. Slot 1524 separates cover panels 1520 and 1521. Panel 1525 is attached to angled supports 1511 and 1512, cover panels 1520 and 1521, and to cross-member 1515. Slot 1526 is integrally formed in panel 1525. User interface 1527 is mounted in panel 1525. Door panel 1528 is hingedly connected to support 1514. Handles 1529 and 1530 are attached to door panel 1528. Panel 1575 is attached to base frame 1501, support 1503, angled support 1510, angled support 1512, and support 1514. Panel 1575 includes access hole 1576. Reservoir 1531 is attached to the interior of cover panel 1521 and adjacent to panel 1575. Reservoir 1531 includes cap 1532. Vacuum system 1533 is removably mounted to base frame 1501. Vacuum system 1533 includes motor 1534, filter assembly 1559 attached to motor 1534, and debris container 1558 attached to filter assembly 1559. Hose 1535 is attached to debris reservoir 1558. Vacuum head 1583 is connected to hose 1535 and is disposed adjacent to cover 1538 and set of wheels 1553.

Service system 1536 is removably connected to base frame 1501. Service system 1536 includes cover 1538 and brush 1537 rotatably attached to cover 1538. Motor 1556 is mounted to cover 1538 and operatively connected to brush 1537. Engagement 1539 is attached to arm support guide 1506. Service system 1540 is pivotally attached to arm support guide 1506 with engagement 1539. Service system 1540 includes arm 1541 pivotally attached to engagement 1539. Rail guide 1553 is attached to arm 1541. Rail guide 1553 is separated from arm 1541 by angle β. Plate 1543 is slidably engaged with rail guide 1553. Slide arm 1542 is attached to plate 1543. Rail cover 1552 is attached to arm 1541 adjacent to rail guide 1553. Set of guides 1551 is rotatably attached to slide arm 1542. Service unit 1544 includes housing 1545. Brackets 1546 and 1547 are attached to housing 1545 and removably connected to plate 1543 with set of removable fasteners 1570. Sprayer 1577 is attached to housing 1545 and is controllably and fluidly connected to reservoir 1531. Motor 1548 is mounted within housing 1545. Belt assembly 1549 is connected to motor 1548. Brush 1550 is rotatably mounted in housing 1545 and operatively connected to belt assembly 1549.

In a preferred embodiment, frame 1501 is made of steel. Other suitable materials, including but not limited to aluminum, plastics, composites, metals, and alloys thereof may be employed.

In a preferred embodiment, each of panels 1517, 1518, 1519, 1525, and 1575, cover panels 1520 and 1521, and door panel 1528 is made of steel. Other suitable materials, including but not limited to aluminum, plastics, composites, metals, and alloys thereof may be employed.

In a preferred embodiment, locking mechanism 1554 has the same structure and functionality as that with respect to the previously described members 20 and 21 and members 220 and 221.

In a preferred embodiment, service system 1536 has the same structure and functionality as the previously described second service systems 44 and 244.

In a preferred embodiment, service system 1540 has the same structure and functionality as the previously described first service systems 42 and 242.

In a preferred embodiment, service unit 1544 has the same structure and functionality as the previously described service units 43 and 243.

In a preferred embodiment, vacuum system 1533 has the same functionality as the previously described system 28.

In one embodiment, service unit 1544 is deployed as a set of interchangeable service units 1544 having various widths to accommodate various widths of movable stairs.

In one embodiment, service system 1536 is deployed as a set of interchangeable service systems 1536 having various widths to accommodate various widths of movable stairs.

In a preferred embodiment, user interface 1527 is an LCD touchscreen. Other suitable interfaces may be employed. User interface 1527 is optionally directly connected and/or mounted on apparatus 1500 itself or be wirelessly connected thereto. In some embodiments when the user interface is directly connected, user interface 1527 optionally includes one or more buttons or knobs or it may be integrated into an LED screen with capacitive sensors. In some embodiments, user interface 1527 optionally includes an activation switch for apparatus 1500, on/off switches, rotational speed, and speed switches associated with service unit 1544 and service system 1536. User interface 1527 further optionally includes controls directed towards automatic or manual release of solution from the sprayer nozzle of either of service unit 1544 and/or service system 1536, actuation control over vacuum system 1533, and/or indexing control over apparatus 1500 itself including by adjustment of frequency and strength of pulses imparted to the one or more indexing wheels.

It will be appreciated by those skilled in the art that any number of fluid pumps, reservoirs, fluid connections, controllers, electrical connections, drive systems, and electrical power supplies may be employed.

Figure 16:
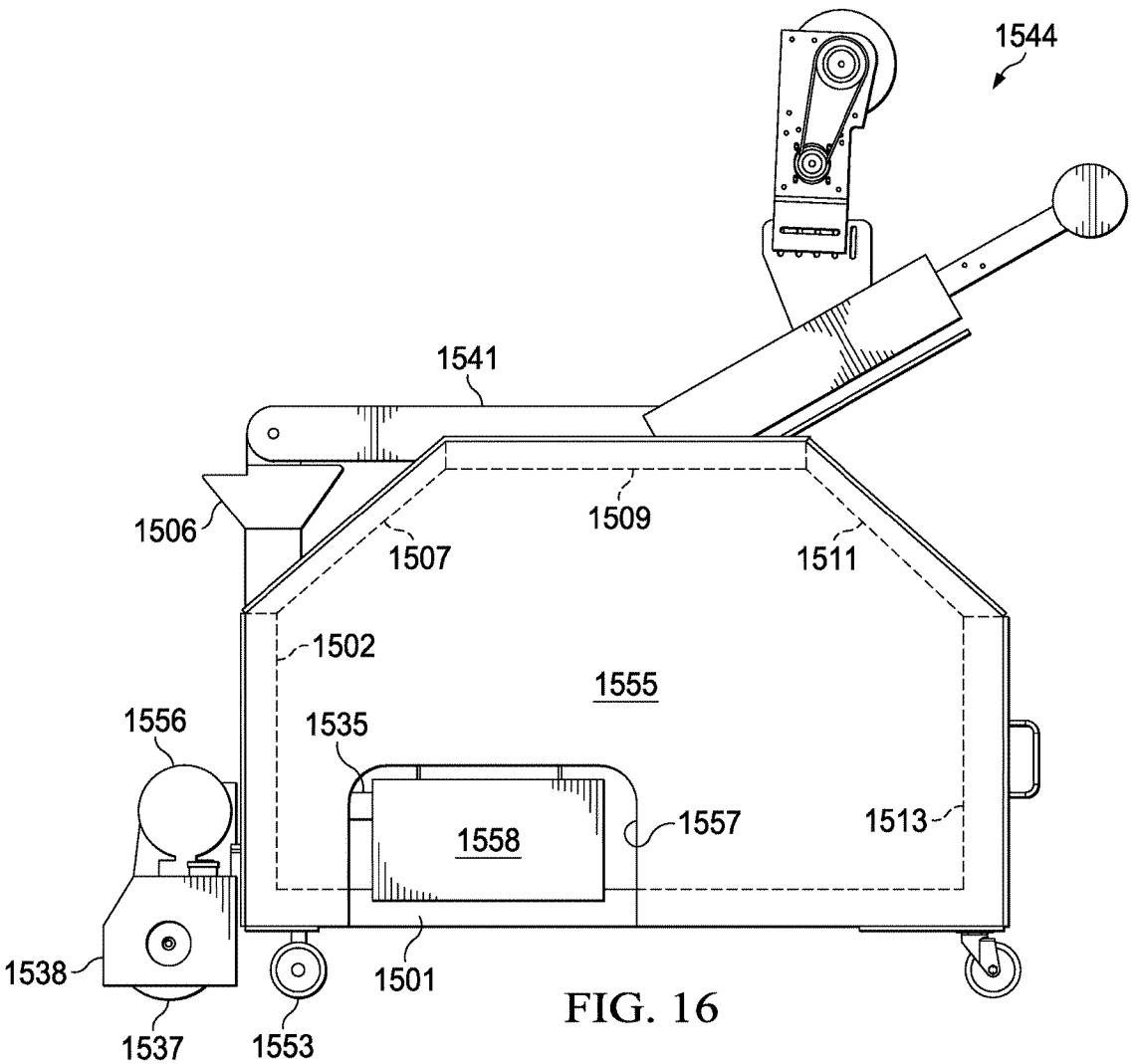
FIG. 16 depicts a side view of the servicing apparatus of another embodiment.

Referring to FIG. 16, panel 1555 is removably attached to base frame 1501, supports 1502 and 1513, angled supports 1507 and 1511, and covers support 1509. Panel 1555 has access hole 1557 integrally formed therein. Motor 1556 is mounted to cover 1538.

In one embodiment, arm 1541 is pivoted with respect to support guide 1506 and positioned generally parallel with cover support 1509. In this way service unit 1544 is stowed when not in use.

In a preferred embodiment, panel 1555 is made of steel. Other suitable materials, including but not limited to aluminum, plastics, composites, metals, and alloys thereof may be employed.

Figure 17:
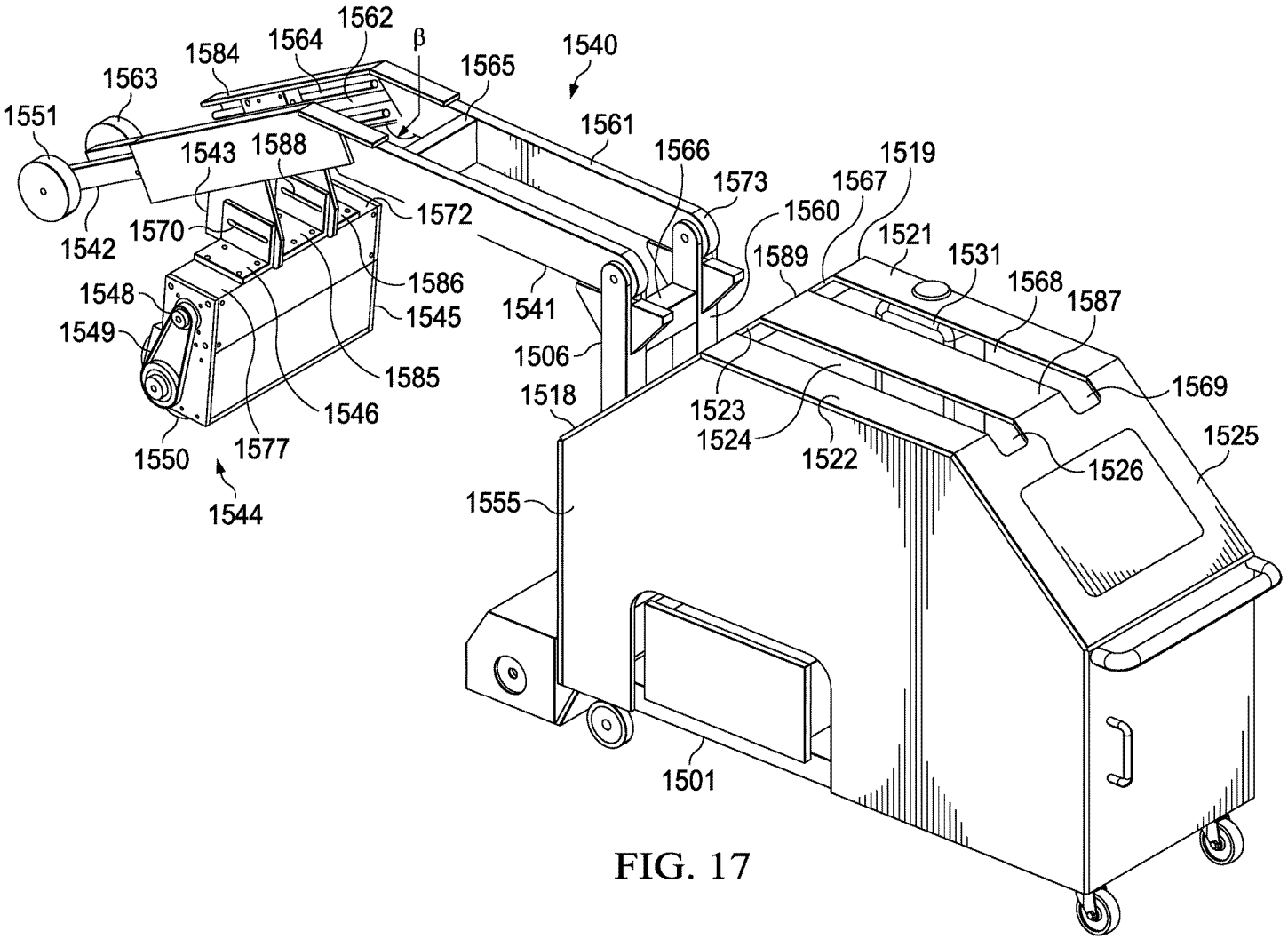
FIG. 17 depicts an isometric view of a servicing apparatus of another embodiment.

Referring to FIG. 17 in another embodiment, service system 1540 includes a second pivotal attachment assembly. Arm support guide 1560 is attached to base frame 1501 in the same manner as arm support guide 1506, as previously described. Engagement 1573 is attached to arm support guide 1560. Service system 1540 is further pivotally attached to arm support guide 1560 with engagement 1573. Service system 1540 further includes arm 1561 attached to engagement 1573. Cross-member 1565 is attached to arms 1541 and 1561. Cross-member 1566 is attached to arm support guides 1506 and 1560. Rail guide 1564 is attached to arm 1561. Rail guide 1564 is separated from arm 1564 by angle β. Plate 1572 is slidably engaged with rail guide 1564. Slide arm 1562 is attached to plate 1572. Rail cover 1584 is attached to arm 1561 adjacent to rail guide 1564. Set of guides 1563 is rotatably attached to slide arm 1562. Service unit 1544 includes housing 1545. Brackets 1546, 1585, and 1586 are attached to housing 1545 and removably connected to plates 1543 and 1572 with sets of removable fasteners 1570 and 1586. Sprayer 1577 is attached to housing 1545 and is controllably and fluidly connected to reservoir 1531. Motor 1548 is mounted within housing 1545. Belt assembly 1549 is connected to motor 1548. Brush 1550 is rotatably mounted in housing 1545 and operatively connected to belt assembly 1549.

Panel 1587 is attached to cross-member 1504 and to cover panel 1587. Panels 1518 and 1589 are separated by slot 1523. Panels 1519 and 1589 are separated by slot 1567.

Cover panel 1587 is attached to panels 1589 and 1525 between cover panels 1521 and 1522 forming slots 1524 and 1568. Slot 1524 separates cover panels 1522 and 1587. Slot 1568 separates cover panels 1587 and 1521. Panel 1525 further includes slot 1569 integrally formed therein adjacent to slot 1568.

In one embodiment, arms 1541 and 1561 are pivoted with respect to arm support guides 1506 and 1560 and positioned generally parallel with cover panel 1587. Arms 1541 and 1561 are partially positioned in slots 1524, 1568, 1526, and 1569. In this way service unit 1544 is stowed when not in use.

Figure 18:
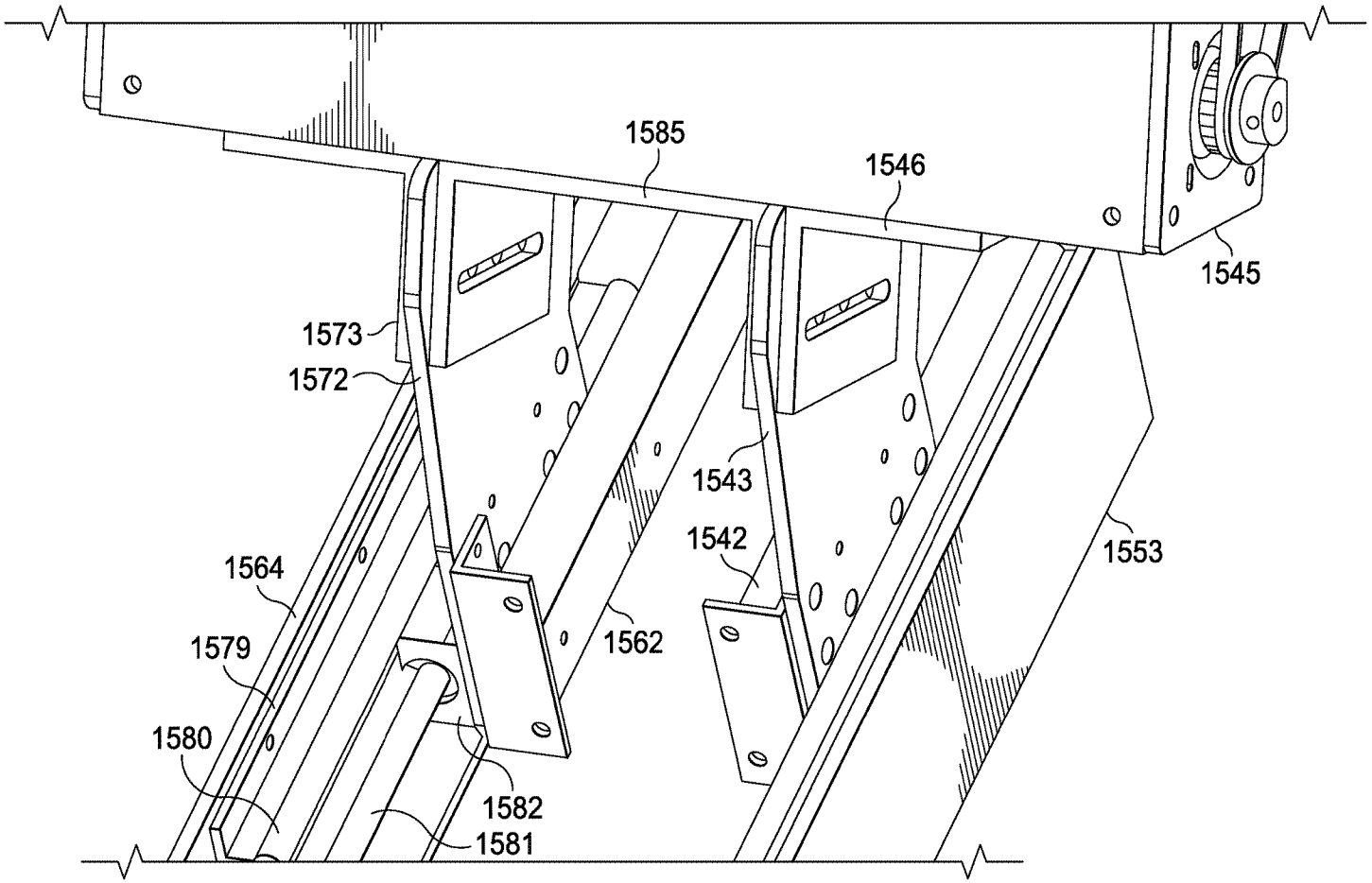
FIG. 18 depicts a detail view of a slidable engagement of another embodiment.

Referring to FIG. 18 by way of example, rail guide 1564 includes rail base 1579. Rail base 1579 includes rails 1580 and 1581 integrally formed thereon. Slidable coupler 1582 is attached to plate 1572 and slidably engaged with rail 1581. Any number of slidable couplers may be employed. Rail guide 1553 includes a corresponding rail base, rails, and slidable couplers.

In a preferred embodiment, rail base 1579 is made of a durable metal, preferably steel. In this embodiment, a suitable lubricant, grease, and/or friction-reducing coating may be employed to engage with slidable coupler 1582. Other suitable materials may be employed.

In a preferred embodiment, slidable coupler 1582 is made of a durable metal, preferably steel. Other suitable materials may be employed.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for servicing a moving stairway, comprising:
- a frame comprising a set of guide arms;
- a first service system movably connected to the frame, the first service system comprising:
  - a frame arm slidably received by the set of guide arms;
  - a pivot arm pivotally attached to the frame arm;
  - a slide arm slidably attached to the pivot arm;
  - a lever mounted to the slide arm; and,
  - a first servicing unit operatively connected to the lever, the first servicing unit operable to clean each stair of the moving stairway;
- a second service system removably mounted to the frame; and,
- wherein the first service system and the second service system simultaneously engage the moving stairway.

2. The apparatus of claim 1, wherein the set of guide arms comprises:
- a plurality of receivers;
- the frame arm comprising a plurality of guide members, each guide member of the plurality of guide members slidably received by a respective receiver of the plurality of receivers between one or more positions.

3. The apparatus of claim 1, wherein a lever angle is formed between a proximal portion of the lever and a distal portion of the lever.

4. The apparatus of claim 3, wherein the lever angle is adjustable between a plurality of angles.

5. The apparatus of claim 1, wherein the slide arm further comprises a rotatable guide member positioned on a distal end of the slide arm.

6. The apparatus of claim 1, wherein the first servicing unit comprises:
- a sprayer system in communication with the lever, the sprayer system operable to distribute liquid solution onto each stair of the moving stairway;
- a brush system adjacent to the sprayer system; and,
- a motor operatively connected to the brush system.

7. An apparatus for servicing a moving stairway, comprising:
- a frame comprising a set of guide arms;
- a first service system movably connected to the frame, the first service system comprising:
  - a set of arms pivotally connected to the set of guide arms;
  - a set of rail guides connected to the set of arms;
  - a first servicing unit slidably engaged with the set of rail guides;
  - a set of slide arms attached to the first servicing unit; and,
  - a set of guides rotatably connected to the set of slide arms;

a second service system removably mounted to the frame; and, wherein the first service system and the second service system simultaneously engage the moving stairway.

8. The apparatus of claim 7, wherein the first servicing unit further comprises:

a lever mounted to one of the slide arms;

a sprayer system in communication with the lever, the sprayer system operable to distribute liquid solution onto each stair of the moving stairway;

a brush system adjacent to the sprayer system; and, a motor operatively connected to the brush system.

9. An apparatus for servicing a moving stairway, comprising:

a frame comprising a set of guide arms;

a first service system movably connected to the frame and comprising:

a set of interchangeable first servicing units, each interchangeable first servicing unit of the set of interchangeable first servicing units having a different width;

a second service system removably mounted to the frame; and, wherein the first service system and the second service system simultaneously engage the moving stairway.

10. An apparatus for servicing a moving stairway, comprising:

a frame comprising a set of guide arms;

a first service system movably connected to the frame;

a second service system removably mounted to the frame, wherein the second service system comprises:

a set of interchangeable second service units, each interchangeable second service unit of the set of interchangeable second service units having a different width; and, wherein the first service system and the second service system simultaneously engage the moving stairway.

11. An apparatus for servicing a moving stairway, comprising:

a frame comprising a set of guide arms;

a locking mechanism operatively connected to the frame, comprising:

a member guide; and, a set of elongated members slidably engaged with the member guide and outwardly extendable from the frame, wherein the locking mechanism is slidably supported by one or more wheels, whereby the apparatus is laterally indexed between a plurality of positions;

a first service system movably connected to the frame;

a second service system removably mounted to the frame; and, wherein the first service system and the second service system simultaneously engage the moving stairway.

12. The apparatus of claim 11, further comprising a drive motor in communication with the one or more wheels supporting the locking mechanism, wherein the drive motor causes the one or more wheels to move or laterally index between the plurality of positions.

* * * * *